US007636529B2

(12) United States Patent
Kamimura

(10) Patent No.: US 7,636,529 B2
(45) Date of Patent: Dec. 22, 2009

(54) PACKAGE, PACKING ASSEMBLY, AND PACKING METHOD FOR USED PROCESS CARTRIDGE

(75) Inventor: Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 385 days.

(21) Appl. No.: 11/358,062

(22) Filed: Feb. 22, 2006

(65) Prior Publication Data

US 2006/0193654 A1 Aug. 31, 2006

(30) Foreign Application Priority Data

Feb. 28, 2005 (JP) ..... 2005-053858

(51) Int. Cl.
*G03G 15/00* (2006.01)

(52) U.S. Cl. ..... 399/107; 206/320; 206/523; 206/576; 206/586

(58) Field of Classification Search ..... 399/107; 206/320, 523, 576, 586
See application file for complete search history.

(56) References Cited

U.S. PATENT DOCUMENTS 5,239,805 A * 8/1993 Uchida et al. ..... 53/412
5,366,080 A * 11/1994 Carstersen et al. ..... 206/723
5,585,889 A * 12/1996 Shishido et al. ..... 399/113
5,742,883 A * 4/1998 Girard et al. ..... 399/262
6,431,362 B1 8/2002 Araki et al.
6,763,210 B2 7/2004 Sato et al.
2003/0209464 A1 * 11/2003 Otsuka et al. ..... 206/586

FOREIGN PATENT DOCUMENTS

| | | | |
|---|---|---|---|
| CN | 2347924 Y | | 11/1999 |
| CN | 1444108 A | | 9/2003 |
| JP | A 07-334066 | | 12/1995 |
| JP | A 08-050441 | | 2/1996 |
| JP | A-11-288155 | | 10/1999 |
| JP | 2000199995 A | * | 7/2000 |
| JP | A-2001-199476 | | 7/2001 |
| JP | A 2001-278342 | | 10/2001 |
| JP | A 2002-293376 | | 10/2002 |
| JP | A 2003-270945 | | 9/2003 |
| JP | B2 3-507377 | | 3/2004 |
| JP | A-2004-205793 | | 7/2004 |

* cited by examiner

*Primary Examiner*—David M Gray
*Assistant Examiner*—Ryan D Walsh
(74) *Attorney, Agent, or Firm*—Oliff & Berridge, PLC

(57) ABSTRACT

The package has an used developer cartridge, a packing case and cushioning members. The packing case is configured with a upper surface that can be opened. When packed in the packing case, the developer cartridge is accommodated in the cushioning members so that the developing roller is positioned vertically above the toner-extracting hole. Recessed parts are formed in the cushioning members, respectively. One recessed part is shaped to closely fit over the upper surface of the developer cartridge. The other recessed part is shaped to fit closes over the lower surface of the developer cartridge. The recessed parts accommodate the developer cartridge so that the developer cartridge has no play therein.

21 Claims, 22 Drawing Sheets

24

PACKAGE, PACKING ASSEMBLY, AND PACKING METHOD FOR USED PROCESS CARTRIDGE

CROSS REFERENCE TO RELATED APPLICATION

This application claims priority from Japanese Patent Application No. 2005-053858 filed Feb. 28, 2005. The entire content of the priority application is incorporated herein by reference.

TECHNICAL FIELD

The invention relates to a packing method and a package for packing a used process cartridge including at least a developer-accommodating section, a developer-carrying member, and a developing section disposed adjacent to the developer-accommodating section and provided with the developer-carrying member.

BACKGROUND

Conventional electrophotographic image-forming devices, such as laser printers, have been provided with process cartridges accommodating a developer and capable of being detachably mounted in the image-forming devices.

This type of process cartridge is partitioned into a developer-accommodating section and a developing section. An agitator provided in the developer-accommodating section is driven to rotate in order to agitate and convey developer into the developing section. The developing section is provided with a developing roller and a supply roller that oppose and contact each other, and a thickness-regulating blade that contacts the surface of the developing roller with pressure.

When the process cartridge is mounted in the laser printer, a gear mechanism or the like inputs a driving force from the laser printer into the process cartridge to rotate the agitator. As a result, the agitator conveys developer from the developer-accommodating section to the developing section. The rotating supply roller in the developing section then supplies this developer onto the developing roller. At this time, the developer is tribocharged between the supply roller and the developing roller. As the developing roller rotates, the developer supplied onto the surface of the developing roller passes beneath the thickness-regulating blade so that a thin layer of uniform thickness is carried on the surface of the developing roller.

This type of process cartridge is mounted in the laser printer so that the developing roller in the cartridge opposes a photosensitive drum in the laser printer. When the thin layer of developer carried on the surface of the developing roller rotates opposite the photosensitive drum, an electrostatic latent image formed on the surface of the photosensitive drum is developed into a toner image. The toner image is subsequently transferred onto a sheet of paper by a transfer roller, thereby forming an image on the paper.

Through repeated use of this process cartridge mounted in the laser printer, developer accommodated in the developer-accommodating section is consumed until the cartridge runs out of toner. At this time, the laser printer displays an out-of-toner message, prompting the user to replace the process cartridge. Accordingly, the user removes the used process cartridge and mounts a new process cartridge in its place.

However, there has been an increasing trend recently to recycle used process cartridges rather than discarded them. In other words, the used process cartridges are refilled with developer and reused.

In order to recycle this type of process cartridge, the user must return the used process cartridge to the manufacturer or to a prescribed recycling factory. Further, the manufacturer or the recycling center must extract any developer remaining in the developer-accommodating section of the used process cartridge to a sufficient degree that old residual developer will not affect the reuse of the process cartridge after the process cartridge has been refilled with new developer.

Various methods for packing new process cartridges have been considered in the past. For example, one method proposed in Japanese Patent Application Publication No. 2001-278342 employs a package including a casing filled with polymerized toner used for image formation, and a packing material for packing the casing so that the casing has a different vertical orientation than during use. More specifically, the casing is packed in the packing material in a state inverted to the state during use. Accordingly, when the user unpacks the casing and mounts the casing at a proper orientation in an image-forming device, the process of inverting the casing from the orientation used during packing eliminates settling and coagulation of the polymerized toner accumulated on the ceiling portion of the casing that may have occurred due to gravity and vibration during transport, thereby reliably loosening up the toner.

SUMMARY

However, when the method for packing a new process cartridge described in Japanese Patent Application Publication No. 2001-278342 is applied to packing used process cartridges, residual developer in the developing section may flow within the developing section when the process cartridge is inverted during packing, but the majority of the developer will remain in the developing section since the developing section and developer-accommodating section are horizontally adjacent to each other during packing. Further, since the developing roller and supply roller disposed in contact with each other and the thickness-regulating blade contacting the surface of the developing roller are disposed in the developing section, residual developer in contact with these components will remain in the developing section when using the packing method described above.

When recycling used process cartridges, the residual developer in the developer-accommodating section of the cartridge is extracted prior to refilling the section with developer. At this time, it is desirable to transfer the residual developer in the developing section into the developer-accommodating section so that no developer remains in the developing section. However, since developer remaining in the developing section is retained therein when employing the packing method of Japanese Patent Application Publication No. 2001-278342 for packing the used process cartridge, it is not possible to extract this developer efficiently.

In view of the foregoing, it is an object of the invention to provide a packing method and a package enabling the developer to be efficiently extracted through a developer-extracting hole formed in the developer-accommodating section prior to refilling the process cartridge with new developer during the recycling process.

This and other object of the invention will be attained by a packing method for a used process cartridge including:

packing the used developer cartridge so that the developer-carrying member is positioned vertically above the developer-extracting hole.

The used process cartridge includes a developer-accommodating section, a developer-carrying member, and a developing section. The developer-accommodating section accommodates a developer and is formed with a developer-extracting hole for extracting residual developer therefrom. The developer-carrying member carries the developer. The developing section is disposed adjacent to the developer-accommodating section. The developer-carrying member is disposed in the developing section.

In another aspect of the invention, there is provided a package including a used process cartridge, a packing case, and a cushioning member.

The used process cartridge includes a developer-accommodating section, a developer-carrying member, and a developing section. The developer-accommodating section accommodates a developer and is formed with a developer-extracting hole for extracting residual developer therefrom. The developer-carrying member carries the developer. The developing section is disposed adjacent to the developer-accommodating section. The developer-carrying member is disposed in the developing section. The packing case with a restricted orientation accommodates the used process cartridge. The cushioning member is accommodated in the packing case. The cushioning member restricts movement of the used process cartridge in the packing case. The cushioning member is shaped to accommodate the used process cartridge in an orientation such that the developer-carrying member is positioned vertically above the developer-extracting hole when the packing case is maintained with an upper surface on top.

In another aspect of the invention, there is provided a packing assembly for use in accommodating a process cartridge. The packing assembly includes a packing case, and a cushioning member.

The process cartridge includes a developer-accommodating section, a developer-carrying member, and a developing section. The developer-accommodating section accommodates a developer and is formed with a developer-extracting hole for extracting residual developer therefrom. The developer-carrying member carries the developer. The developing section is disposed adjacent to the developer-accommodating section. The developer-carrying member is disposed in the developing section. The packing case with a restricted orientation accommodates the process cartridge. The cushioning member is accommodated in the packing case. The cushioning member restricts movement of the process cartridge inside the packing case. The cushioning member is shaped to accommodate the process cartridge in an orientation such that the developer-carrying member is positioned vertically above the developer-extracting hole when the process cartridge is placed in the packing case, and the upper surface of the packing case is facing upward.

In another aspect of the invention, there is provided a packing method for a used process unit including:

packing the used developer cartridge so that the developer-carrying member is positioned vertically above the developer-extracting hole.

The used process unit includes a photosensitive member, a used process cartridge, a transferring unit, a charging unit, and a cleaning unit. The photosensitive member has a surface on which an electrostatic latent image is formed and developer is deposited. The used process cartridge supplies developer to a recording member to form a toner image thereon. The transferring unit transfers the toner image on the photosensitive member onto the recording medium. The charging unit charges the photosensitive member. The cleaning unit cleans the surface of the photosensitive member. The process cartridge includes a developer-accommodating section, a developer-carrying member, and a developing section. The developer-accommodating section accommodates a developer and is formed with a developer-extracting hole for extracting residual developer therefrom. The developer-carrying member carries the developer. The developing section is disposed adjacent to the developer-accommodating section. The developer-carrying member is disposed in the developing section.

In another aspect of the invention, there is provided a package including a used process unit, a packing case, and a cushioning member.

The used process unit includes a photosensitive member, a process cartridge, a transferring unit, a charging unit, and a cleaning unit. The photosensitive member has a surface on which an electrostatic latent image is formed and developer is deposited. The used process cartridge supplies developer to a recording member to form a toner image thereon. The transferring unit transfers the toner image on the photosensitive member onto the recording medium. The charging unit charges the photosensitive member. The cleaning unit cleans the surface of the photosensitive member. The used process cartridge includes a developer-accommodating section, a developer-carrying member, and a developing section. The developer-accommodating section accommodates a developer and is formed with a developer-extracting hole for extracting residual developer therefrom. The developer-carrying member carries the developer. The developing section is disposed adjacent to the developer-accommodating section. The developer-carrying member is disposed in the developing section. The packing case with a restricted orientation accommodates the used process cartridge. The cushioning member is accommodated in the packing case. The cushioning member restricts movement of the used process cartridge in the packing case. The cushioning member is shaped to accommodate the used process cartridge in an orientation such that the developer-carrying member is positioned vertically above the developer-extracting hole when the packing case is maintained with an upper surface on top.

In another aspect of the invention, there is provided a packing assembly for use in accommodating a process unit. The packing assembly includes a packing case, and a cushioning member.

The process unit includes a photosensitive member, a process cartridge, a transferring unit, a charging unit, and a cleaning unit. The photosensitive member has a surface on which an electrostatic latent image is formed and developer is deposited. The process cartridge supplies developer to a recording member to form a toner image thereon. The transferring unit transfers the toner image on the photosensitive member onto the recording medium. The charging unit charges the photosensitive member. The cleaning unit cleans the surface of the photosensitive member.

The process cartridge includes a developer-accommodating section, a developer-carrying member, and a developing section. The developer-accommodating section accommodates a developer and is formed with a developer-extracting hole for extracting residual developer therefrom. The developer-carrying member carries the developer. The developing section is disposed adjacent to the developer-accommodating section. The developer-carrying member is disposed in the developing section. The packing case with a restricted orientation accommodates the process cartridge. The cushioning member is accommodated in the packing case. The cushioning member restricts movement of the process cartridge inside the packing case. The cushioning member is shaped to accommodate the process cartridge in an orientation such that the developer-carrying member is positioned vertically above the developer-extracting hole when the process cartridge is placed in the packing case, and the upper surface of the packing case is facing upward.

DETAILED DESCRIPTION

Next, a packing method and a package according to some aspects of the invention will be described with reference to the accompanying drawings.

Figure 1:
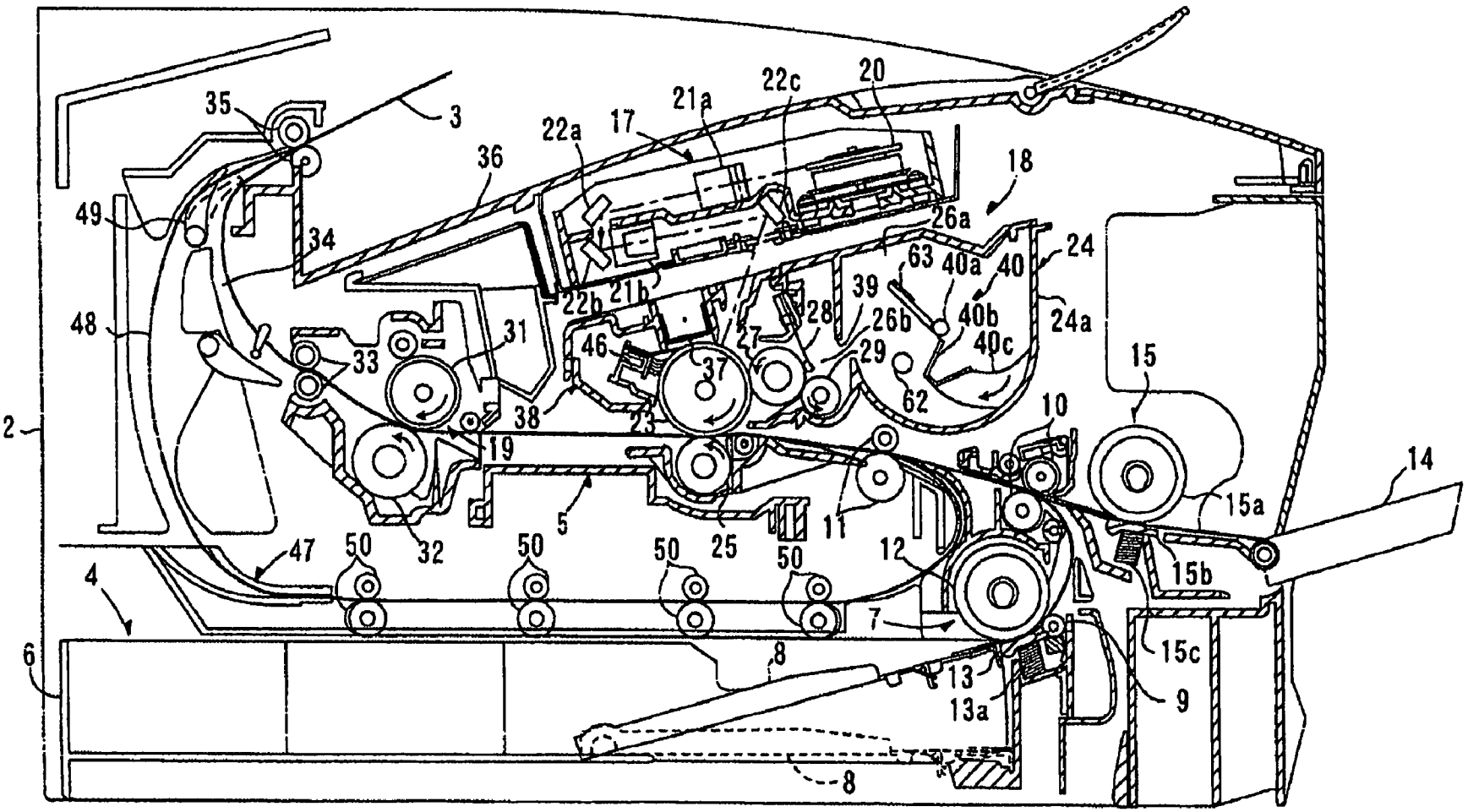
FIG. 1 is a side cross-sectional view of a laser printer having a developer cartridge mounted therein.

A laser printer 1 shown in FIG. 1 is an electrophotographic image forming device according to the present embodiment. As shown in FIG. 1, the laser printer 1 includes a main casing 2, a feeder unit 4, and an image-forming unit 5. The main casing 2 houses the feeder unit 4 and the image-forming unit 5. The feeder unit 4 is for feeding recording sheets 3, and the image-forming unit 5 is for forming prescribed images on the recording sheet 3.

The feeder unit 4 includes a sheet supply tray 6, a sheet supply mechanism 7, a sheet pressing plate 8, paper dust removing rollers 9, 10, and registration rollers 11. The sheet supply tray 6 is detachably mounted at the bottom section of the main casing 2. The sheet supply mechanism 7 is disposed at one end of the sheet supply tray 6. The sheet pressing plate 8 is disposed inside the sheet supply tray 6. The paper dust removing rollers 9, 10 are disposed downstream of a sheet feed direction in which the recording sheets 3 are conveyed (hereinafter, upstream or downstream with respect to the sheet feed direction will be abbreviated simply to "upstream" or "downstream"). The registration rollers 11 are disposed downstream of the paper dust removing rollers 9, 10 with respect to the sheet feed direction.

The paper supply tray 6 has an open-top box shape capable of accommodating a stack of recording sheets 3 and can be inserted into and removed from the bottom section of the main casing 2 horizontally.

The sheet supply mechanism 7 has a supply roller 12 and a separation pad 13 opposite the supply roller 12. A spring 13*a* is located on the rear side of the separation pad 13 and presses the separation pad 13 against the supply roller 12.

The sheet pressing plate 8 is capable of supporting a stack of sheets 3. The sheet pressing plate 8 is pivotably supported at its end furthest from the supply roller 12 so that the end of the sheet pressing plate 8 that is nearest the supply roller 12 can move upward and downward. Although not shown in the drawings, a spring for urging the sheet pressing plate 8 upward is provided to the rear surface of the sheet pressing plate 8. Therefore, the sheet pressing plate 8 pivots downward around the end of the sheet pressing plate 8 farthest from the sheet supply mechanism 7 in accordance with increase in the amount of sheets 3 stacked on the sheet pressing plate 8, against the urging force of the spring. Urging force of the spring under the sheet pressing plate 8 presses the uppermost sheet 3 on the sheet pressing plate 8 toward the supply roller 12 so that rotation of the supply roller 12 moves the uppermost sheet 3 between the supply roller 12 and the separation pad 13.

In this way, the supply roller 12 separates one sheet 3 at a time from the stack and supplies the same to the paper dust removing rollers 9, 10 in cooperation with the separation pad 13. The paper dust removing rollers 9, 10 remove paper dust from the sheet 3, and then the sheet 3 is conveyed to the registration rollers 11.

The registration rollers 11 perform a desired registration operation on the supplied sheets 3 and transports the same to an image formation position where a photosensitive drum 23 and a transfer roller 25 contact each other. In other words, the image formation position is a transfer position where a visible toner image is transferred from the surface of the photosensitive drum 23 to a sheet 3.

The feeder unit 4 further includes a multipurpose tray 14 in which a stack of paper sheets 3 of an arbitrary size is mounted and a multipurpose paper feed mechanism 15 for feeding the paper sheets 3 stacked in the multipurpose tray 14.

The multipurpose paper feed mechanism 15 has a multipurpose paper feed roller 15*a* and a multipurpose separation pad 15*b* opposite the multipurpose paper feed roller 15*a*. A spring 15*c* is located on the rear side of the multipurpose separation pad 15*b*, and the multipurpose separation pad 15*b* is pressed against the multipurpose paper feed roller 15*a* by the urging force of the spring 15*c*.

The topmost sheet 3 of the stack in the multipurpose tray 14 is taken up between the multipurpose paper feed roller 15*a* and the multipurpose separation pad 15*b* by the rotation of the multipurpose paper feed roller 15*a*, and is separated and fed one at a time toward the registration rollers 11 by the cooperative action of these two.

The image forming unit 5 includes a scanner section 17, a process unit 18, and a fixing section 19.

The scanner section 17 is provided at the upper section of the main casing 2 and is provided with a laser emitting section (not shown), a rotatingly driven polygon mirror 20, lenses 21*a*, 21*b*, and reflection mirrors 22*a*, 22*b*, 22*c*. The laser emitting section emits a laser beam based on desired image data. As indicated by single-dot chain line in FIG. 1, the laser beam passes through or is reflected by the mirror 20, the lens 21*a*, the reflection mirrors 22*a* and 22*b*, the lens 21*b*, and the reflection mirror 22*c* in this order so as to irradiate, in a high speed scanning operation, the surface of the photosensitive drum 23 of the process unit 18.

The process unit 18 is disposed below the scanner section 17. The process unit 18 includes a drum cartridge 38 detachably mounted in the main casing 2. The drum cartridge 38 houses the photosensitive drum 23, a developing cartridge 24, a transfer roller 25, a scorotron charger 37, and a cleaning brush 46.

The developing cartridge 24 is detachably mounted in the drum cartridge 38. The developing cartridge 24 can be inserted into or removed from the drum cartridge 38 both when the drum cartridge 38 has been removed from the main casing 2 and when the drum cartridge 38 is installed therein.

Figure 2:
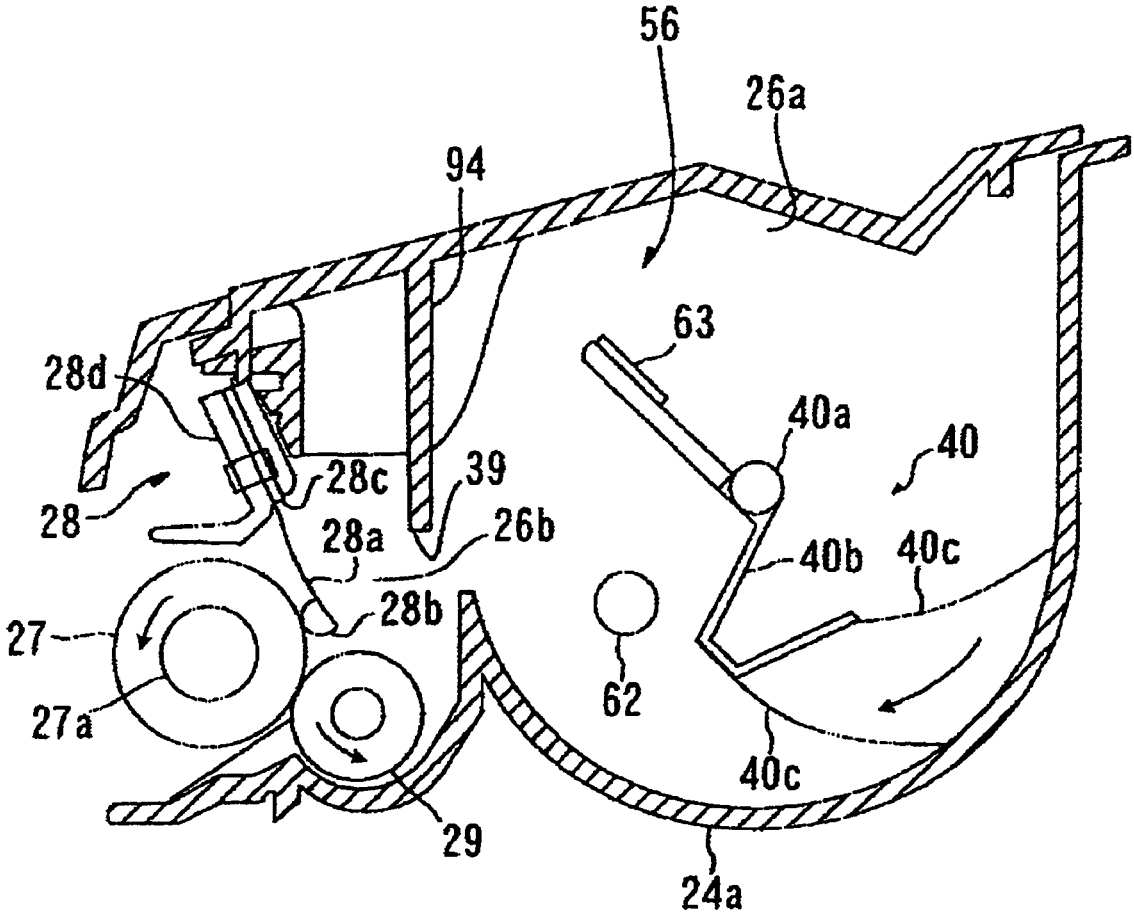
FIG. 2 is a side cross-sectional view of the developer cartridge used in the laser printer of FIG. 1.

As shown in FIG. 2, inside a casing 24*a* of the developing cartridge 24 is divided into a toner chamber 26*a* and a developing chamber 26*b* as separate compartments while being reinforced by a plurality of inner ribs 94 (only one of the inner ribs 94 is shown in FIG. 2). Toner supply apertures 39 are formed between the inner ribs 94 and the casing 24*a*. The plurality of inner ribs 94 are arranged in a lengthwise direction of the casing 24*a*. It is noted that one portion of the casing 24 forming the toner chamber 26*a* is provided integrally with the other portion of the casing 24 forming the developing chamber 26*b*, however, one portion of the casing 24 forming the toner chamber 26*a* may be linked to the other portion of the casing 24 forming the developing chamber 26*b* as a separate member As shown in FIG. 2, an agitator 40 is rotatably disposed inside the toner chamber 26*a*, and the toner chamber 26*a* is filled with positively charging, non-magnetic, single-component toner.

In this embodiment, polymerization toner is used as the toner. To produce polymerization toner, a polymerizing monomer is dissolved or dispersed in a polymerization medium together with a polymerization starting agent, a colorant such as carbon black, and as necessary, a cross-linking agent, charge control agent, and other additives. Then, the resultant mixture is subjected to a suspension polymerization by stirring and dispersing the mixture during the aqueous phase. Examples of a polymerizing monomer include a styrene type monomer or an acrylic type monomer. An example of a styrene type monomer is styrene. Examples of acrylic type monomers are acrylic acid, acrylic (C1-C4) acrylate, and acrylic (C1-C4) metaacrylate. The polymerization toner has roughly spherical grains with an average diameter of approximately 6 to 10 μm, and has extremely good fluidity. A colorant such as carbon black, wax, and so forth, are mixed with this polymerization toner. Also, an external additive, such as silica, titanium oxide, aluminum oxide, or the like, is added to the toner base particles in order to improve the fluidity of the toner.

The agitator 40 has a rotating shaft 40*a*, an agitation blade 40*b*, and a film member 40*c*. The rotating shaft 40*a* is rotatably supported in the center of the toner chamber 26*a*. The agitation blade 40*b* is fitted around the rotating shaft 40*a*, and the film member 40*c* is affixed to a free end of the agitation blade 40*b*. The rotating shaft 40*a* is driven to rotate by motive power from a gear mechanism section (not shown) together with the agitation blade 40*b*. Through the rotation of the agitation blade 40*b*, the film member 40*c* scrapes up and transports the toner inside the toner chamber 26*a* into the developing chamber 26*b*. A cleaner 63 for cleaning windows 62 (described later) is fitted to the rotating shaft 40*a* on the opposite side to the agitation blade 40*b*.

A developing roller 27, a thickness regulation blade 28, and a supply roller 29 are disposed inside the developing chamber 26*b*.

The supply roller 29 is disposed below the toner supply apertures 39 so as to be rotatable in a direction indicated by an arrow (counterclockwise direction in FIG. 2). The supply roller 29 has a metal roller shaft covered by a roller made of an electrically conductive sponge material.

The developing roller 27 is disposed to the side of the supply roller 29 so as to be rotatable in a direction indicated by an arrow (counterclockwise direction in FIG. 2). The developing roller 27 includes a metal roller shaft covered by a roller that is formed of an electrically conductive resilient material. More specifically, the roller of the developing roller 27 is formed of an electrically conductive urethane rubber or silicon rubber including fine carbon particles, the surface of which is coated with a urethane rubber or silicon rubber including fluorine. A developing bias is applied to the developing roller 27 with respect to the photosensitive drum 23.

The supply roller 29 and the developing roller 27 are positioned opposite each other and in mutual contact so that each is compressed to a certain degree.

The thickness regulation blade 28 is positioned above the developing roller 27 and opposed along the axial direction of the developing roller 27 at a position near the developing roller 27.

The thickness regulation blade 28 has a leaf spring 28*a*, a pressing part 28*b*, a backup member 28*c*, and a supporting member 28*d*. The pressing part 28*b* is made of insulative silicone rubber to have a semicircular cross-section and contacts the developing roller 27. The backup member 28*c* is provided on the rear surface of the leaf spring 28*a*. The supporting member 28*d* is for supporting the rear end of the leaf spring 28*a* in the casing 24*a* of the developing cartridge 24. With the leaf spring 28*a* supported in the casing 24*a* by the supporting member 28*d*, the pressing part 28*b* is pressed against the surface of the developing roller 27 by the elastic force of the leaf spring 28*a* pressed by the backup member 28*c*.

Figure 3:
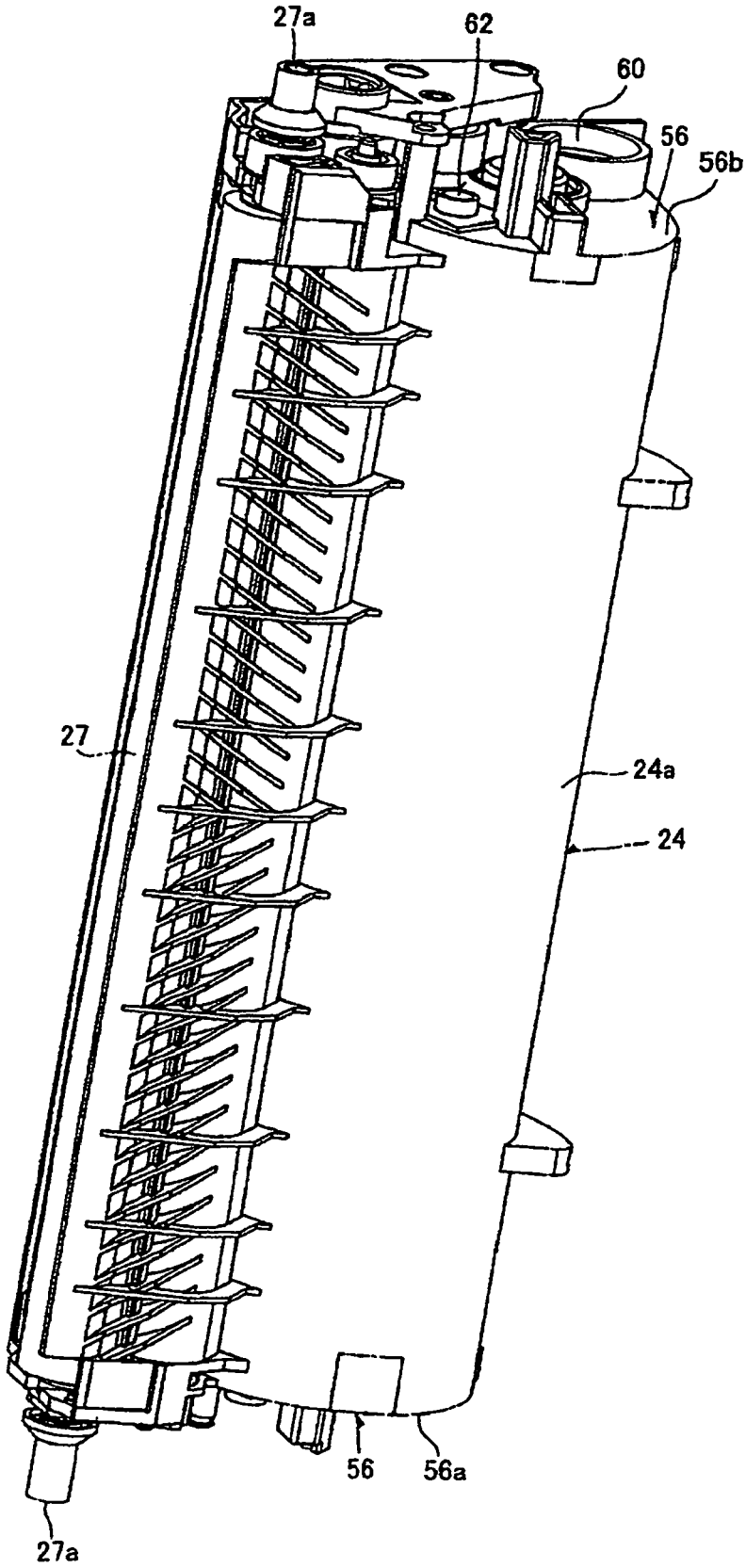
FIG. 3 is a perspective view of the developer cartridge in FIG. 2.

As shown in FIGS. 2 and 3, the side of the casing 24*a* on which the developing roller 27 is disposed is open, and both axial ends of the roller shaft 27*a* of the developing roller 27 are rotatably supported in end walls 56 (56*a*, 56*b*) of the casing 24*a*.

A gear mechanism (not shown) is provided on one end wall 56*a*. When motive power from a motor (not shown) is input to the gear mechanism, the developing roller 27, the supply roller 29, and the agitator 40 are rotated. The other end wall 56*b* is formed with a toner-extracting hole 60 whereby the toner chamber 26*a* can be opened and closed by a toner cap (not shown).

The toner-extracting hole 60 is used for inserting a suction member (not shown) in order to suck up toner remaining inside the developing cartridge 24 from the toner chamber 26*a* as will be described later.

With this configuration, the toner inside the toner chamber 26*a* is scraped up and transported through the toner supply apertures 39 to the developing chamber 26*b* by the rotation of the agitator 40 in the direction indicated by the arrow. The end walls 56 of the toner chamber 26*a* are formed with the windows 62 for passing light to a photosensor (not shown). As mentioned above, the windows 62 are cleaned by the cleaner 63. The windows 62 are used when detecting the remaining amount of toner. That is, when the toner chamber 26*a* is full of toner, the light does not pass through the toner chamber 26*a*. On the other hand, when the amount of toner remaining in the toner chamber 26*a* becomes low, the light passes through the toner chamber 26*a* and the windows 62. As a result, and an "out of toner" indication is displayed on an operation panel (not shown) disposed on the main casing 2.

The toner transported into the developing chamber 26*b* through the toner supply apertures 39 is supplied to the developing roller 27 by the rotation of the supply roller 29. At this time, the toner is positively tribocharged between the supply roller 29 and the developing roller 27. Further, the toner supplied onto the developing roller 27 is carried between the pressing part 28*b* of the thickness regulation blade 28 and the developing roller 27 with the rotation of the developing roller 27, forming a thin layer of toner having a uniform thickness on the developing roller 27.

As shown in FIG. 1, the photosensitive drum 23 is supported to the side of the developing roller 27 and in confrontation with the developing roller 27 so as to be rotatable in a direction indicated by an arrow (clockwise direction in FIG. 1). The photosensitive drum 23 is formed of a main drum that is grounded. The surface of the main drum is a positively charging photosensitive layer formed of polycarbonate or the like.

The scorotoron charger 37 is disposed above the photosensitive drum 23 and is spaced away from the photosensitive drum 23 by a predetermined space so as to avoid direct contact with the photosensitive drum 23. The scorotron charger 37 is a positive-charge scorotron type charge unit for generating a corona discharge from a tungsten charge wire, for example, to uniformly charge the surface of the photosensitive drum 23 to a positive charge.

The cleaning brush 46 is disposed opposite and in contact with the photosensitive drum 23 at a position downstream of the image formation position, at which the photosensitive drum 23 contacts the transfer roller 25, and upstream of the scorotron charger 37 in the rotating direction of the photosensitive drum 23.

As the photosensitive drum 23 rotates, the scorotron charger 37 forms a uniform positive charge over the surface of the rotating photosensitive drum 23. Subsequently, the surface of the photosensitive drum 23 is exposed by the high-scanning of the laser beam emitted from the scanner section 17 based on image data. As a result, electrostatic latent images are formed on the surface of the photosensitive drum 23.

When the positively charged toner carried on the surface of the developing roller 27 opposes and contacts the photosensitive drum 23 as the developing roller 27 rotates, the toner is selectively supplied to the electrostatic latent image on the photosensitive drum 23, i.e., to areas of the surface of the uniformly charged photosensitive drum 23 that were exposed to the laser beam and, therefore, have a lower potential than the rest of the surface. As a result, the electrostatic latent images on the photosensitive drum 23 are transformed into visible toner images. In this way, a reverse development is performed.

The transfer roller 25 is rotatably supported in the drum cartridge 38 at a position below and in confrontation with the photosensitive drum 23. The transfer roller 25 includes a metal roller shaft and a roller portion covering the roller shaft. The roller portion is made from electrically-conductive rubber material. At the time of toner image transfer, the transfer roller 25 is applied with a predetermined transfer bias with respect to the photosensitive drum 23.

The toner image carried on the surface of the photosensitive drum 23 is transferred to the recording sheet 3 as the recording sheet 3 passes between the photosensitive drum 23 and the transfer roller 25. The recording sheet 3 with the toner image transferred thereon is conveyed to the fixing section 19.

Residual toner remaining on the photosensitive drum 23 after the image transfer is cleaned off by the cleaning brush 46.

The fixing section 19 is disposed to the side of and downstream from the process unit 18 in the sheet feed direction. The fixing section 19 includes a heat roller 31, a pressing roller 32, and conveying rollers 33. The pressing roller 32 presses against the heat roller 31, and the conveying rollers 33 are disposed downstream of the heat roller 31 and the pressing roller 32.

The heat roller 31 is made of metal and has a halogen lamp for heating. A toner image transferred onto a recording sheet 3 is thermally-fixed to the recording sheet 3 while the recording sheet 3 passes between the heat roller 31 and the pressing roller 32. Thereafter, the recording sheet 3 is transported to a discharge path 34 by the conveying rollers 33. After being transported to the discharge path 34, the recording sheet 3 is discharged onto a discharge tray 36 by discharge rollers 35.

The laser printer 1 further includes a reverse conveying unit 47 for enabling a duplex printing to print images both sides of the sheet 3. The reverse conveying unit 47 includes the discharge rollers 35, a reverse conveying path 48, a flapper 49, and a plurality of reverse conveying rollers 50.

The reverse conveying rollers 50 are disposed below the transfer position. The reverse conveying path 48 extends vertically between the discharge rollers 35 and the reverse conveying rollers 50. The upstream end of the reverse conveying path 48 is located near the discharge rollers 35 and the downstream end is located near the reverse conveying rollers 50 so that sheets 3 can be transported downward from the discharge rollers 35 to the reverse conveying rollers 50.

The flapper 49 is pivotably provided at a branch point between the discharge path 34 and the reverse conveying path 48. By toggling the excitation of a solenoid (not shown) ON and OFF, the conveying direction of the recording sheet 3 reversed by the discharge rollers 35 can be switched from the direction toward the discharge path 34 to the direction toward the reverse conveying path 48.

The reverse conveying rollers 50 are disposed in a substantially horizontal direction above the discharge tray 6. The reverse conveying rollers 50 farthest upstream are positioned near the downstream end of the reverse conveying path 48. The reverse conveying rollers 50 farthest downstream are positioned below the registration rollers 11.

When forming images on both sides of the recording sheet 3, the reverse conveying unit 47 is operated as follows. After having an image formed on one surface, the recording sheet 3 is conveyed by the conveying rollers 33 to the discharge rollers 35 via the discharge path 34. With the recording sheet 3 interposed between the discharge rollers 35, the discharge rollers 35 rotate in a forward rotation, conveying the recording sheet 3 temporarily outward (toward the discharge tray 36), such that a large part of the recording sheet 3 is fed out of the main casing 2. When the trailing edge of the recording sheet 3 becomes interposed between the discharge rollers 35, the discharge rollers 35 halt their forward rotation. Next, the discharge rollers 35 rotate in the reverse direction, and also the flapper 49 switches the conveying direction to convey the recording sheet 3 toward the reverse conveying path 48. Hence, the recording sheet 3 is conveyed toward the reverse conveying path 48 leading now with the trailing edge. After the recording sheet 3 is conveyed into the reverse conveying path 48, the flapper 49 is switched to its original state, that is, the position for conveying the recording sheet 3 supplied from the conveying rollers 33 toward the discharge rollers 35.

Next, the recording sheet 3 conveyed along the reverse conveying path 48 in the reverse direction is conveyed to the reverse conveying rollers 50, which in turn convey the recording sheet 3 upward to the registration rollers 11. The registration rollers 11 adjust the recording sheet 3 to a proper register and convey the same toward the image formation position with its upper front and back surfaces switched, enabling images to be formed on both sides of the recording sheet 3.

Then, the recording sheet 3 with images formed on both sides is transported to the fixing section 19 where the images are thermally fixed to the sheet 3, and is discharged onto the discharge tray 36.

With this laser printer 1, when an "out of toner" indication is given, the developing cartridge 24 with little remaining toner is removed, and another developing cartridge 24 full of toner is inserted. The removed developing cartridge 24 whose toner has been used up is not discarded, but is refilled with toner and reused. "Reused" means being used for developing again after having once been used for developing.

In order to reuse a used developing cartridge 24, it is necessary to remove toner remaining inside the toner chamber 26*a* of the used developing cartridge 24 to such an extent that remaining toner does not affect the insertion and use of new toner (for example, leaving no more than 14 g of residual toner in the case of a developing cartridge that contains 190 g of toner when full).

Next, a package 101 and a packing method for packing the used developer cartridge 24 according to a first embodiment of the invention will be described with reference to FIGS. 4 through 8.

Figure 4:
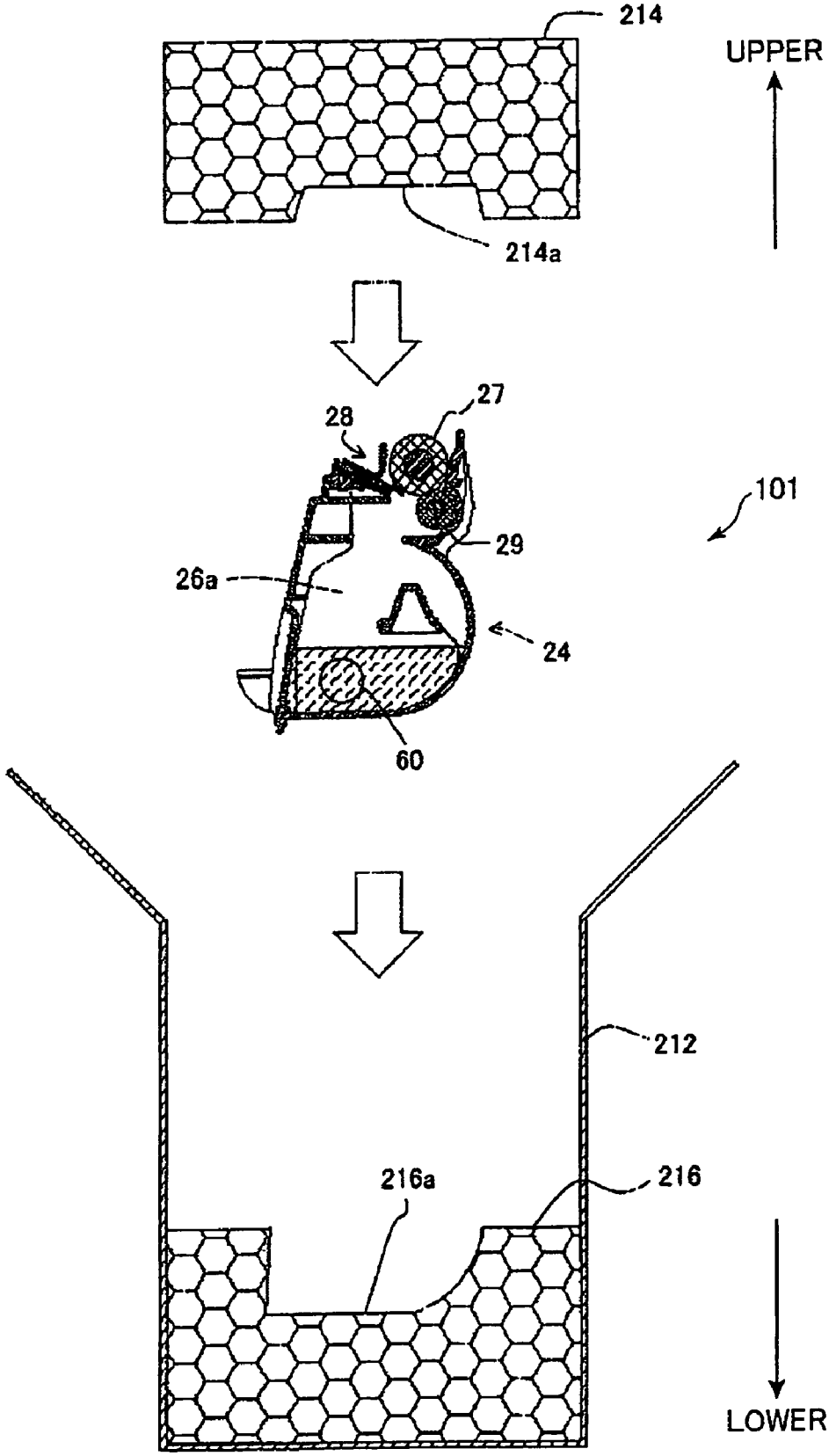
FIG. 4 is an exploded diagram illustrating a package for packing a used developer cartridge according to a first embodiment.
Figure 5:
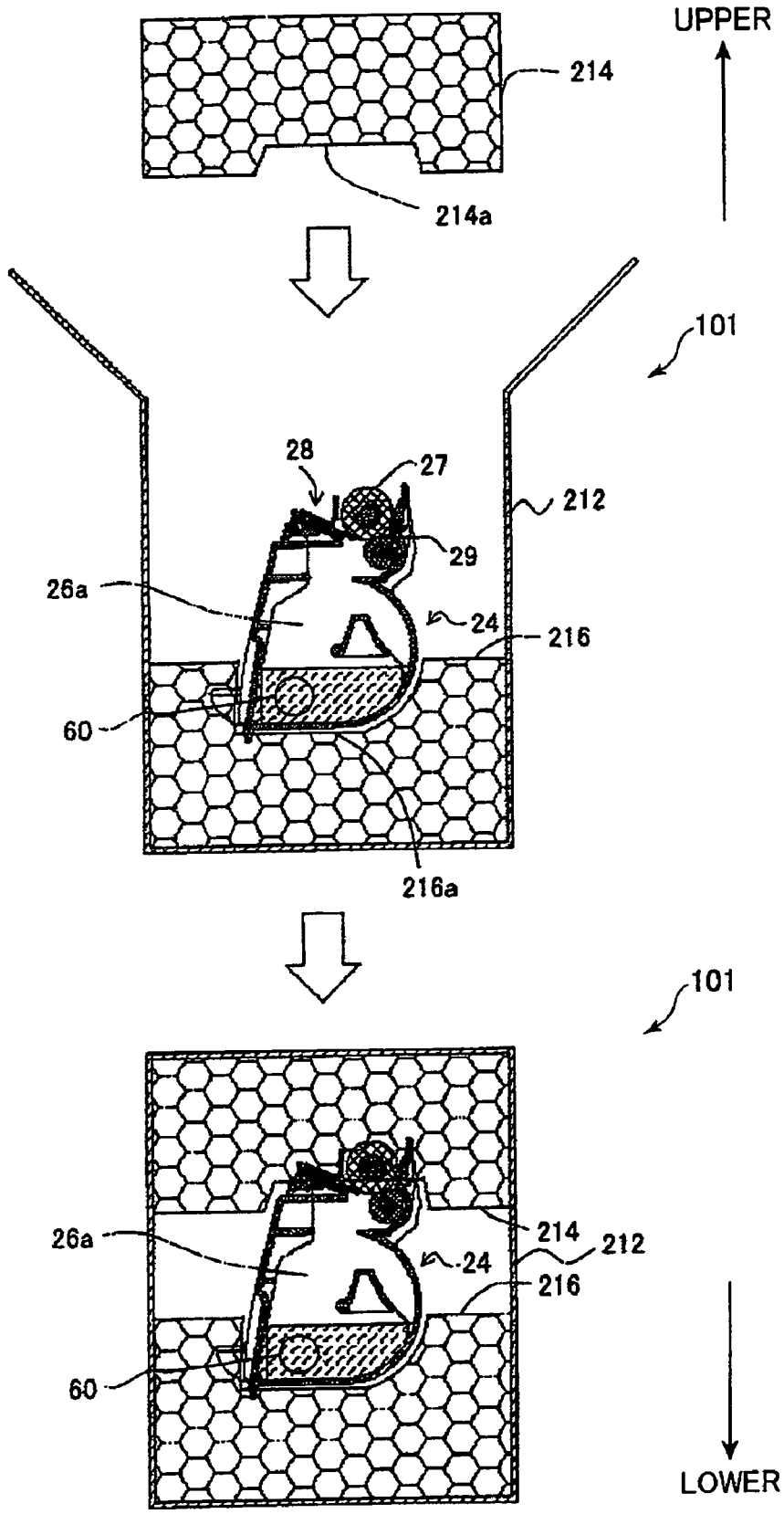
FIG. 5 is an exploded diagram illustrating the package for packing the used developer cartridge according to the first embodiment.

FIGS. 4 and 5 are explanatory diagrams illustrating the packing method for packing a used developer cartridge 24 according to the first embodiment. As shown in FIGS. 4 and 5, the package 101 according to the first embodiment has the used developer cartridge 24, a packing case 212 and cushioning members 214 and 216. In the following description, a vertical direction of the packing case 212 when in its proper orientation will be the direction that the cushioning member 214 faces the cushioning member 216, and the cushioning member 214 side of the packing case 212 will be the upper side while the cushioning member 216 side is the lower side.

Figure 6A:
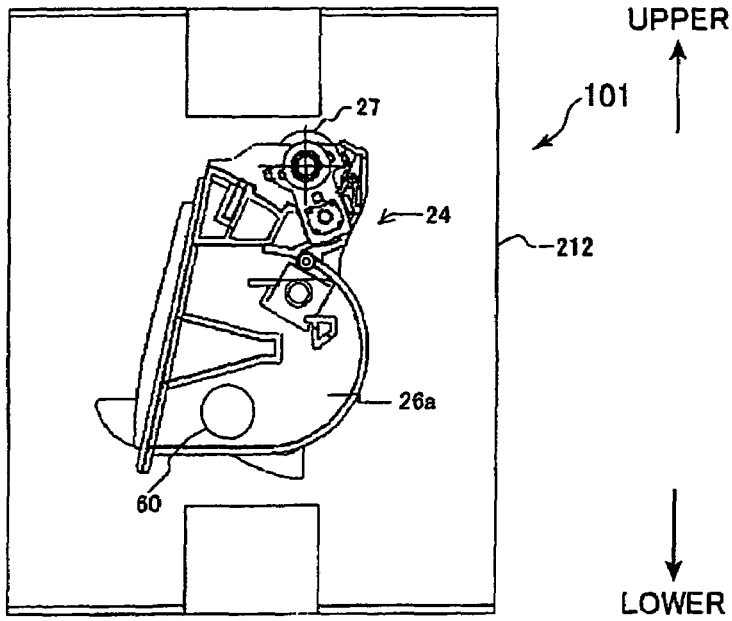
FIG. 6A is a side view of the used developer cartridge packed according to the package of the first embodiment.
Figure 6B:
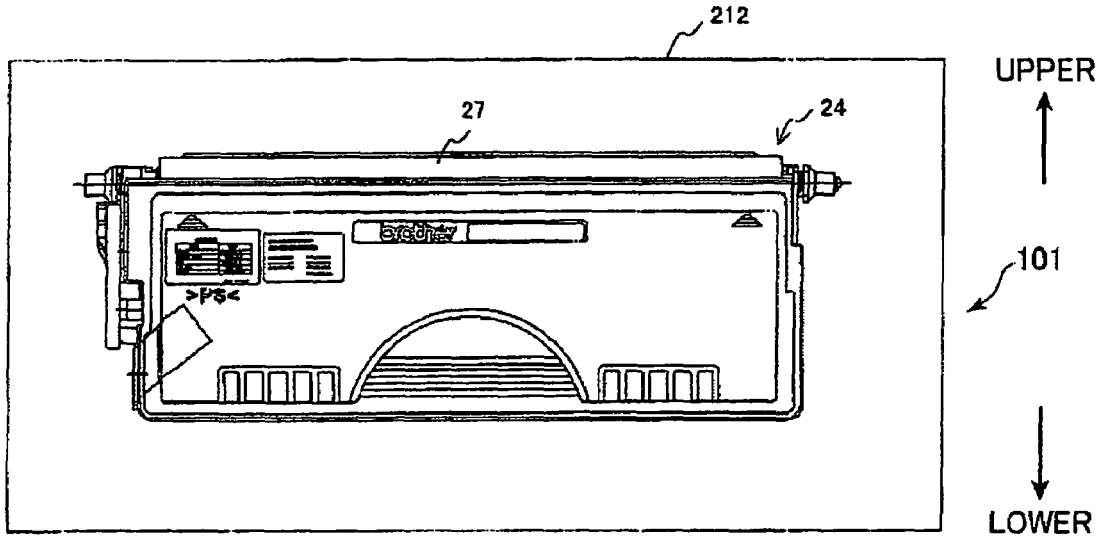
FIG. 6B is a front view of the used developer cartridge packed according to the package of the first embodiment.

FIGS. 6A and 6B do not show the cushioning members 214 and 216 to illustrate the orientation in which the developer cartridge 24 is maintained in the packing case 212. FIG. 6A is a view of the packing case 212 from a side surface abutting one of the short edges of the upper surface on the packing case 212. FIG. 6B is a view of the packing case 212 from a side surface abutting one of the long edges of the upper surface.

Figure 7A:
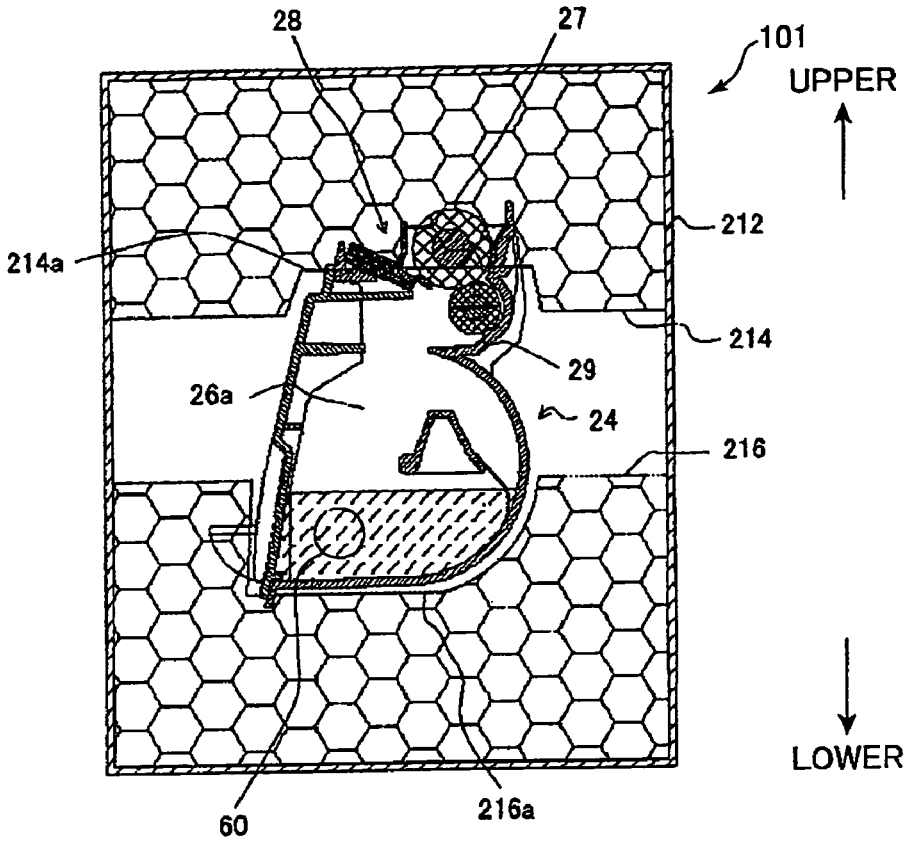
FIG. 7A is a side view of the used developer cartridge that has been packed together with cushioning members.
Figure 7B:
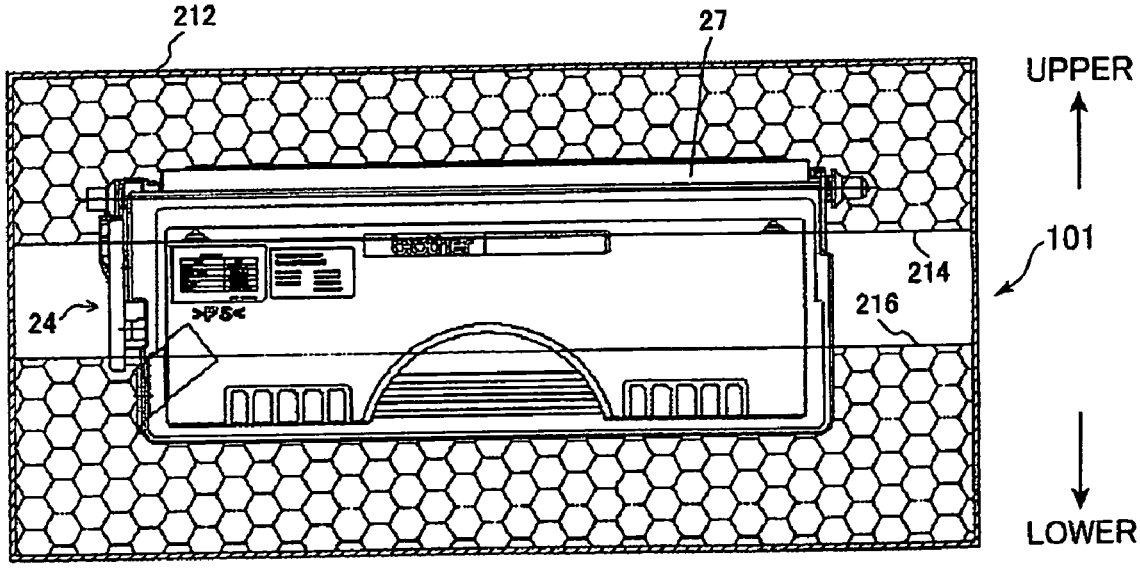
FIG. 7B is a front view of the used developer cartridge that has been packed together with cushioning members.

FIGS. 7A and 7B show the state of the developer cartridge 24 when accommodated in the cushioning members 214 and 216. FIG. 7A is a view from a side surface abutting one short edge on the upper surface of the packing case 212, while FIG. 7B is a view from a side surface abutting one of the long edges on the upper surface of the packing case 212.

Figure 8:
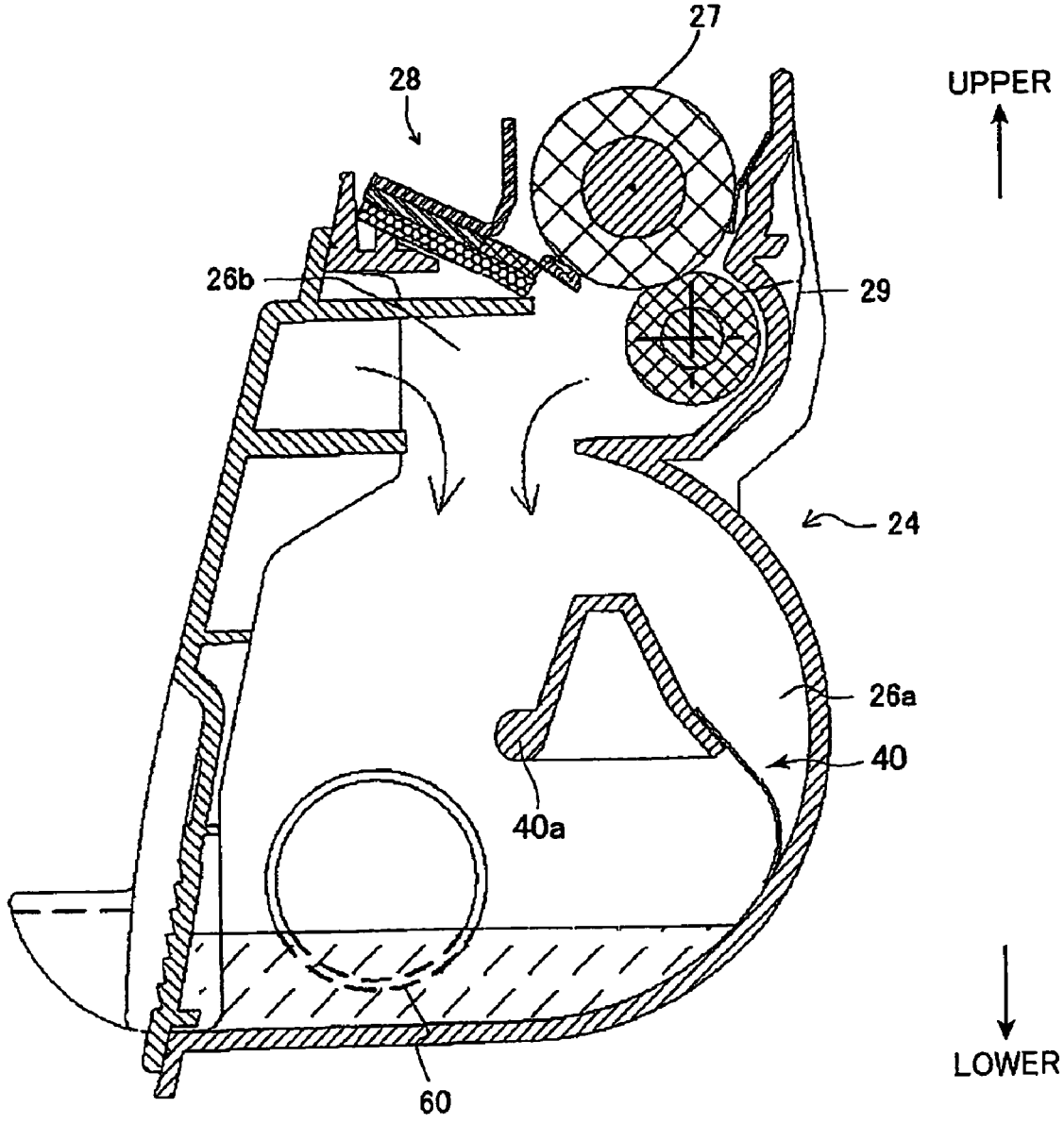
FIG. 8 is a side cross-sectional view of the used developer cartridge when packed in a packing case.

FIG. 8 is a side cross-sectional view of the developer cartridge 24 when the developer cartridge 24 is packed in the packing case 212.

As shown in FIGS. 4 and 5, the packing case 212 is configured with a upper surface that can be opened. As shown in FIGS. 4 through 8, when packed in the packing case 212, the developer cartridge 24 is accommodated in the cushioning members 214 and 216 so that the developing roller 27 is positioned vertically above the toner-extracting hole 60. The cushioning member 214 is disposed in the upper region of the packing case 212 and accommodates the upper portion of the developer cartridge 24. The cushioning member 216 is disposed in a lower region of the packing case 212 and accommodates a lower portion of the developer cartridge 24. Recessed parts 214*a* and 216*a* are formed in the cushioning members 214 and 216, respectively. The recessed part 214*a* is shaped to closely fit over the upper surface of the developer cartridge 24. The recessed part 216*a* is shaped to fit closes over the lower surface of the developer cartridge 24. The recessed parts 214*a* and 216*a* accommodate the developer cartridge 24 so that the developer cartridge 24 has no play therein. By restraining the developer cartridge 24 from above and below, the cushioning members 214 and 216 can restrict movement of the developer cartridge 24 inside the packing case 212.

Further, the cushioning member 216 is fixed by adhesive to at least a portion of the lower surface inside the packing case 212. However, the method of fixing the cushioning member 216 is not limited to fixation by adhesive.

As shown in FIG. 4, when packing the developer cartridge 24 in the packing case 212, the user first places the developer cartridge 24 in the recessed part 216*a* of the cushioning member 216 so that the developing roller 27 is positioned vertically above the toner-extracting hole 60. Next, as shown in FIG. 5, the user fits the cushioning member 214 over the developer cartridge 24 with the recessed part 214*a* facing downward. Subsequently, the user closes the upper surface of the packing case 212 and seals the upper surface with packing tape or the like.

In this packing case 212, the cushioning member 216 is fixed to the inside lower surface of the packing case 212. Therefore, when the packing case 212 is placed in its proper vertical orientation and the user attempts to insert the used developer cartridge 24 through the opening in the upper surface, the used developer cartridge 24 can only be accommodated in the packing case 212 in such a way that the shape of the developer cartridge 24 conforms to the shape of the recessed part 216*a* since the cushioning member 216 is fixed in the lower of the packing case 212 with the recessed part 216*a* facing upward. Hence, the developer cartridge 24 can only be packaged in the packing case 212 in an orientation with the developing roller 27 positioned vertically above the toner-extracting hole 60. This configuration reliably prevents the developer cartridge 24 from being packed in any other orientation.

As shown in FIG. 8, the supply roller 29 and thickness regulation blade 28 are disposed in the developing chamber 26*b* of the developer cartridge 24 in contact with the developing roller 27. Since the recessed part 216*a* of the cushioning member 216 is shaped to fit closely over the lower surface of the developer cartridge 24, the developer cartridge 24 can only be packed in the packing case 212 in an orientation in which the supply roller 29 is positioned vertically above the toner-extracting hole 60. Therefore, this configuration can reliably prevent the developer cartridge 24 from being packaged in the packing case 212 in any other orientation. Similarly, the developer cartridge 24 can only be packed in the packing case 212 in an orientation in which the thickness regulation blade 28 is positioned vertically above the toner-extracting hole 60. Therefore, this configuration can reliably prevent the developer cartridge 24 from being packaged in the packing case 212 in any other orientation.

Figure 9:
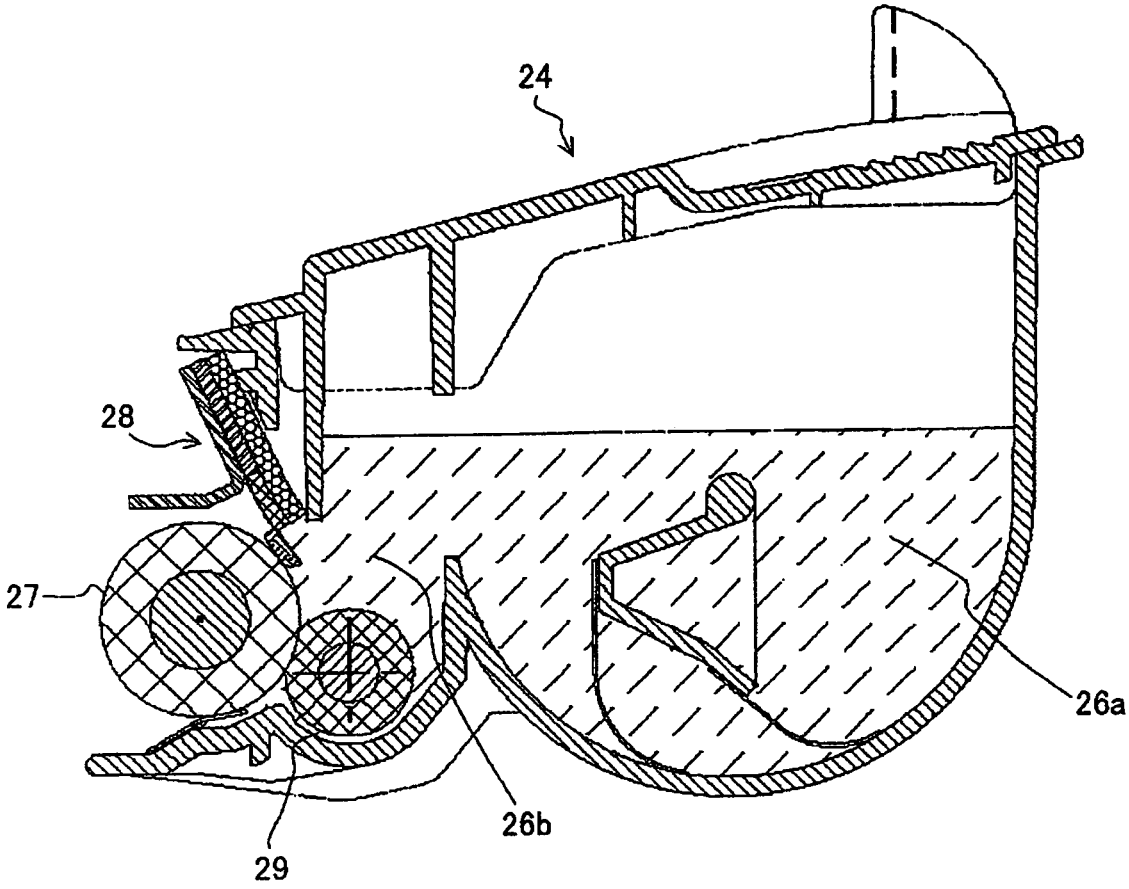
FIG. 9 is a side cross-sectional view of a developer cartridge when mounted in the laser printer.

As described above, the developing roller 27 and supply roller 29 are disposed in contact with each other in the developing chamber 26*b* of the developer cartridge 24, while the thickness regulation blade 28 contacts the surface of the developing roller 27. Hence, when the developer cartridge 24 is mounted in the laser printer 1 and a normal printing operation is performed, a sufficient amount of toner can be supplied from the toner chamber 26*a* into the developing chamber 26*b*, as shown in FIG. 9, to fill the region around the developing roller 27, supply roller 29, and thickness regulation blade 28 with toner. In this way, the supply roller 29 can supply toner onto the developing roller 27, while the thickness regulation blade 28 regulates the toner on the surface of the developing roller 27 to a prescribed thickness for developing an electrostatic latent image formed on the surface of the photosensitive drum 23. However, when the toner chamber 26*a* runs out of toner, making it necessary to replace the developer cartridge 24, the amount of toner remaining in the developing chamber 26*b* and around the developing roller 27 is nearly the same as during normal printing.

The surface of the supply roller 29 provided in the developing chamber 26*b* is formed of an electrically conductive sponge material. Hence, when toner is deposited on the surface of the supply roller 29, much of the toner remains thereon, even at the point of contact with the developing roller 27.

Further, since the thickness regulation blade 28 is configured of the leaf spring member 28*a*, the pressing part 28*b*, the backup member 28*c*, and the support member 28*d*, a large amount of toner remains in the gaps and spaces between these members.

When packaged, the developer cartridge 24 is oriented with the developing roller 27 positioned vertically above the toner-extracting hole 60. Accordingly, toner in the developing chamber 26*b* and toner around the developing roller 27 will shift toward the toner chamber 26*a* due to gravity and vibration during transport.

When packaged, the developer cartridge 24 is oriented with the supply roller 29 positioned vertically above the toner-extracting hole 60. Accordingly, toner around the supply roller 29 also shifts toward the toner chamber 26*a* due to gravity and vibration during transport.

When packaged, the developer cartridge 24 is oriented with the thickness regulation blade 28 positioned vertically above the toner-extracting hole 60. Accordingly, toner around the thickness regulation blade 28 also shifts toward the toner chamber 26*a* due to gravity and vibration during transport.

When the developer cartridge 24 is oriented such that the developing roller 27 is positioned vertically above the toner-extracting hole 60, the toner-extracting hole 60 is positioned lower than the center of the toner chamber 26*a*. Further, since the agitator 40 is disposed inside the toner chamber 26*a* and the rotational shaft 40*a* of the agitator 40 is rotatably supported in the center of the toner chamber 26*a*, the toner-extracting hole 60 is positioned below the position at which the rotational shaft 40*a* of the agitator 40 is supported.

If the manufacturer or recycling factory to which the developer cartridge 24 is returned maintains the developer cartridge 24 in the same orientation as when packed, toner remaining in the developing chamber 26*b* and in the mounted region of the developing roller 27, supply roller 29, and thickness-regulating blade 28 shifts down and collects on the bottom of the toner chamber 26*a*. Accordingly, the manufacturer or recycling factory can efficiently extract toner from the toner-extracting hole 60 according to the conventional method without interference from the agitator 40 and other members.

Next, a package 111 and a packing method for packing a used developer cartridge 24 according to a second embodiment of the invention will be described with reference to FIGS. 10 through 12, wherein like parts and components are designated with the same reference numerals to avoid duplicating description.

Figure 10:
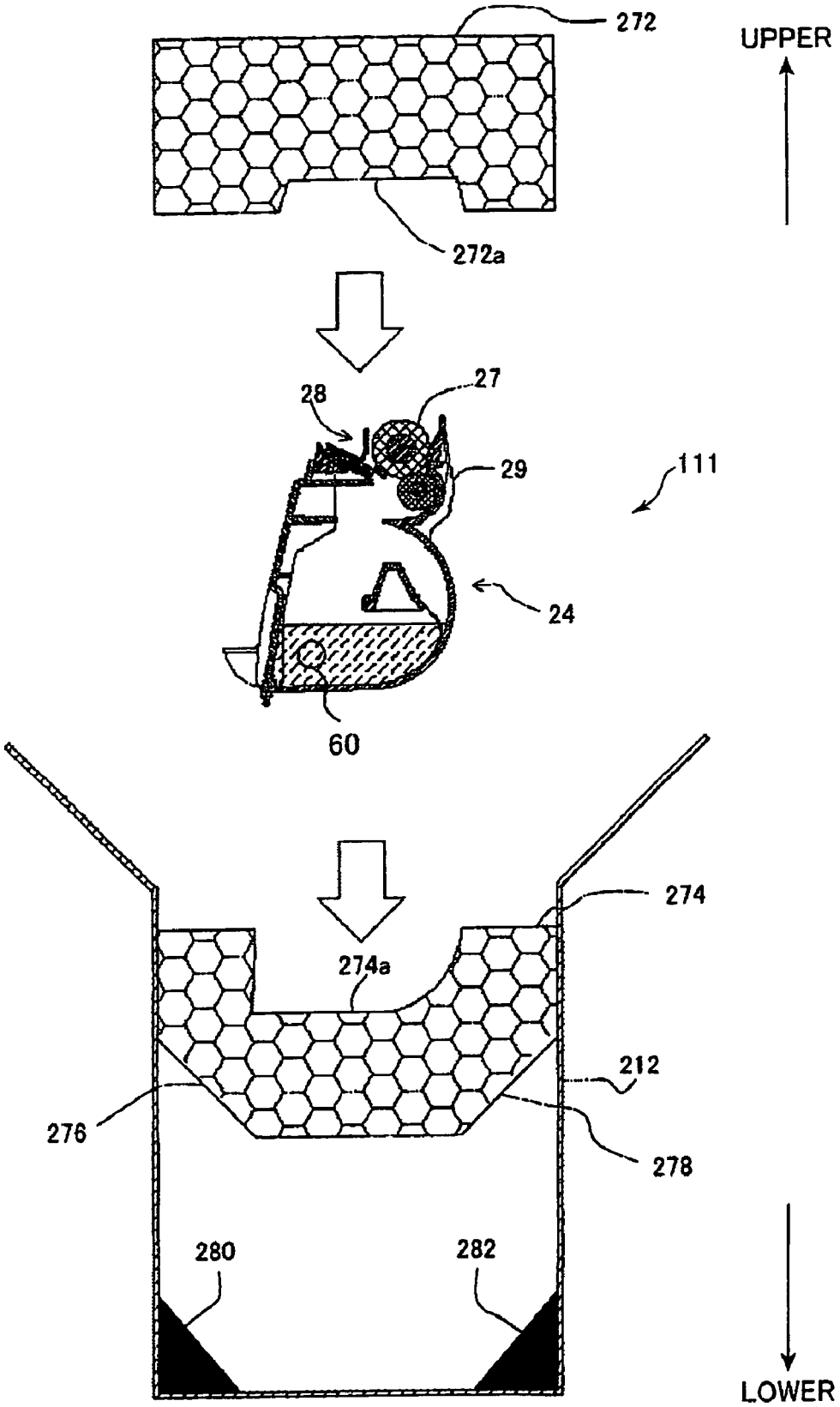
FIG. 10 is an exploded diagram illustrating a method of packing a used developer cartridge according to a second embodiment.
Figure 11:
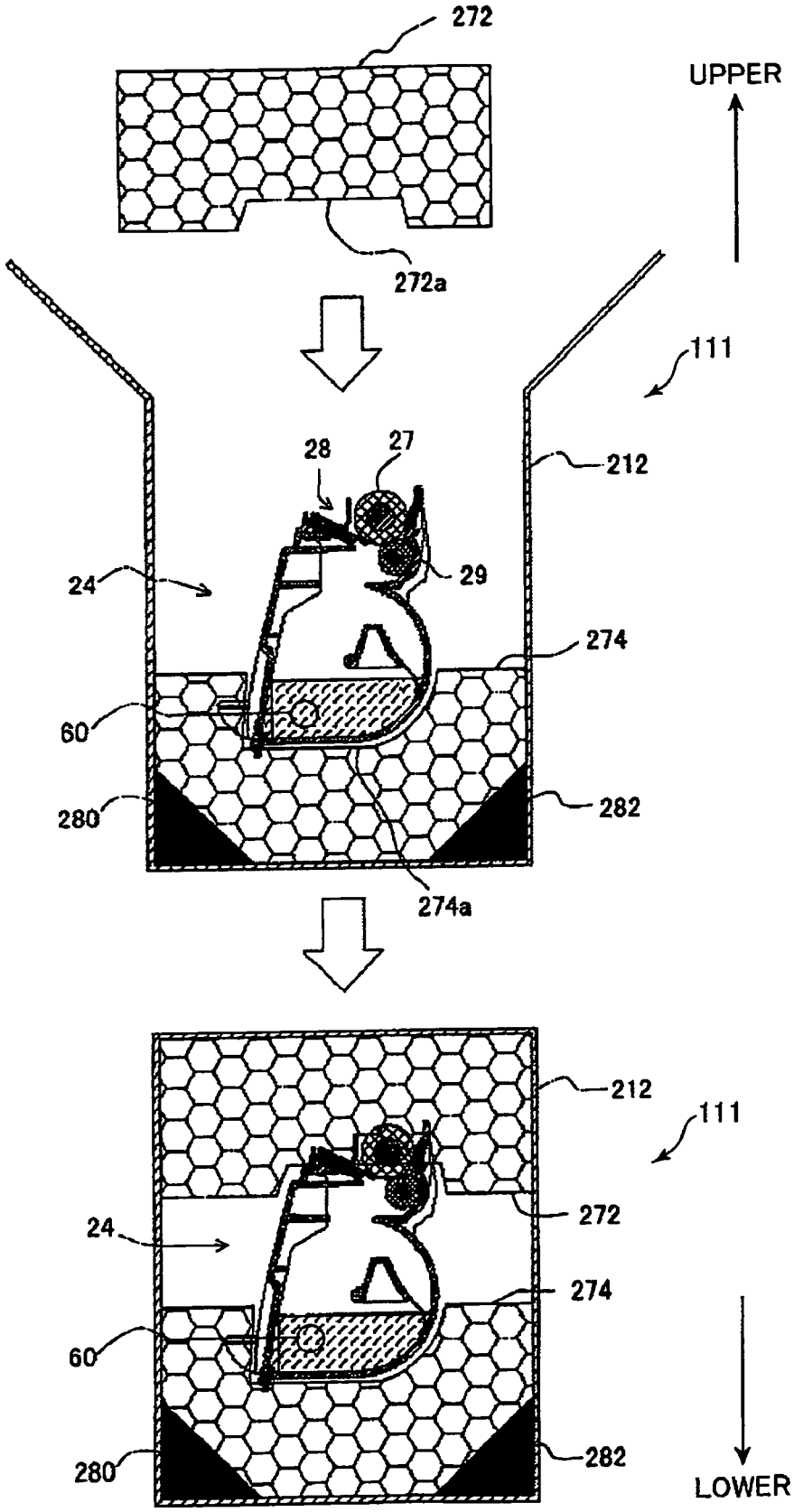
FIG. 11 is an exploded diagram illustrating the package for the used developer cartridge according to the second embodiment.

FIGS. 10 and 11 are explanatory diagrams illustrating the packing method for packing a used developer cartridge 24 according to the second embodiment. As shown in FIGS. 10 and 11, the packing assembly 111 according to the second embodiment has the used developing cartridge 24, a packing case 212, and cushioning members 272 and 274. In the following description, a vertical direction of the packing case 212 when in its proper orientation will be the direction that the cushioning member 272 faces the cushioning member 274, and the cushioning member 272 side of the packing case 212 will be the upper side while the cushioning member 274 side is the lower side. Recessed parts 272*a* and 274*a* similar to the recessed parts 214*a* and 216*a* are formed in the cushioning members 272 and 274, respectively.

The packing method according to the second embodiment differs from the packing method according to the first embodiment in that the cushioning member 274 accommodating the bottom portion of the developer cartridge 24 includes cutout parts 276 and 278 formed in portions opposing the long edges on the lower surface of the packing case 212, and positioning members 280 and 282 fixed in inner portions along the long sides of the lower surface. The shape of the cutout parts 276 and 278 substantially conforms to the shape of the positioning members 280 and 282.

When packing a used developer cartridge 24 in the packing case 212, the user first inserts the cushioning member 274 into the packing case 212. As described above, the positioning members 280 and 282 are fixed in the packing case 212, and the cushioning member 274 has the cutout parts 276 and 278 that conform to the shape of the positioning members 280 and 282. Accordingly, the cushioning member 274 can only be placed in the packing case 212 with the cutout parts 276 and 278 facing downward and oriented so as to conform to the positioning members 280 and 282, as shown in FIG. 10.

Next, the user inserts the used developer cartridge 24 into the packing case 212. Here, the developer cartridge 24 can only be accommodated in an orientation where the lower portion matches the shape of the recessed part 274*a* formed in the cushioning member 274, as shown in FIG. 11. Specifically, the developer cartridge 24 can only be accommodated in the packing case 212 in an orientation with the developing roller 27 positioned vertically above the toner-extracting hole 60.

Next, the user inserts the cushioning member 272 into the packing case 212. At this time, the cushioning member 272 can only be accommodated in the packing case 212 with the recessed part 272*a* facing downward and fitted over the upper portion of the developer cartridge 24.

Through this operation, the developer cartridge 24 and the cushioning members 272 and 274 are accommodated at prescribed positions in the packing case 212. Subsequently, the user may close the upper surface of the packing case 212 and seal the closed upper surface with packing tape or the like.

Since the positioning members 280 and 282 are fixed in the packing case 212, as described above, the cushioning member 274 can only be placed in the packing case 212 in an orientation that conforms to the shape of the positioning members 280 and 282. Further, since the cushioning member 274 is configured such that the developer cartridge 24 must be oriented to tightly fit into the recessed part 274*a*, this configuration reliably prevents the developer cartridge 24 from being packaged in the packing case 212 in any other orientation.

By packing the developer cartridge 24 in the orientation described above, toner remaining in the developing chamber 26*b* shifts toward the toner chamber 26*a* due to gravity and vibration during transport. Accordingly, by maintaining the developer cartridge 24 in the orientation used during packing, the manufacturer or prescribed recycling factory to which the developer cartridge 24 is returned can efficiently extract toner from the toner-extracting hole 60 according to the conventional method.

Figure 12:
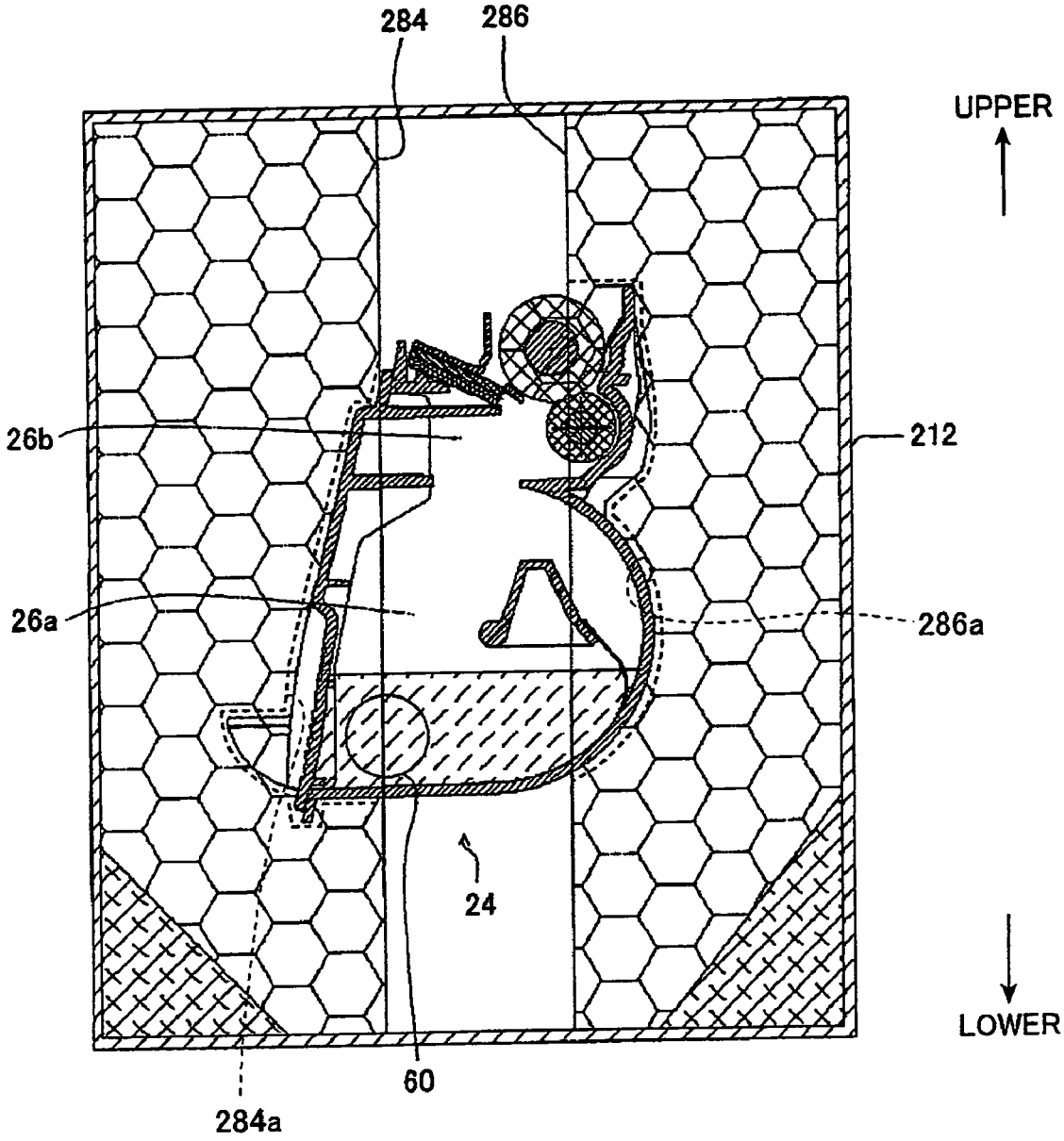
FIG. 12 is a side view showing a variation of the cushioning members used to accommodate the used developer cartridge.

FIG. 12 shows another example of cushioning members used to accommodate the developer cartridge 24 in the packing case 212. In this variation of the second embodiment, cushioning members 284 and 286 are disposed on both side surfaces of the developer cartridge 24 so that the side portions of the developer cartridge 24 are accommodated in the cushioning members 284 and 286. Recessed parts 284*a* and 286*a* are formed in the cushioning members 284 and 286, respectively, in regions opposing the developer cartridge 24 and are shaped so as to closely fit over the opposing parts of the developer cartridge 24. This configuration also forces toner remaining in the developing chamber 26*b* to shift toward the toner chamber 26*a* due to gravity and vibration during transport. Accordingly, by maintaining the developer cartridge 24 in the orientation used during packing, the manufacturer or recycling factory to which the developer cartridge 24 is returned can efficiently extract toner from the toner-extracting hole 60 according to the conventional method.

In the packing method according to the second embodiment, the cushioning member 274 includes the cutout parts 276 and 278 cut out from regions opposing the long edges in the lower surface of the packing case 212, and the positioning members 280 and 282 are fixed to the inside of the packing case 212 along the long edges of the lower surface thereof and are shaped to conform substantially to the cutout parts 276 and 278. However, the cushioning members and positioning members of the preferred embodiment described above may be formed in a different shape, provided that at least a portion of the cushioning members conforms to at least a portion of the positioning members.

Next, markings for indicating the proper vertical orientation of the packing case 212 according to the present invention will be described with reference to FIGS. 13 and 14.

Figure 13:
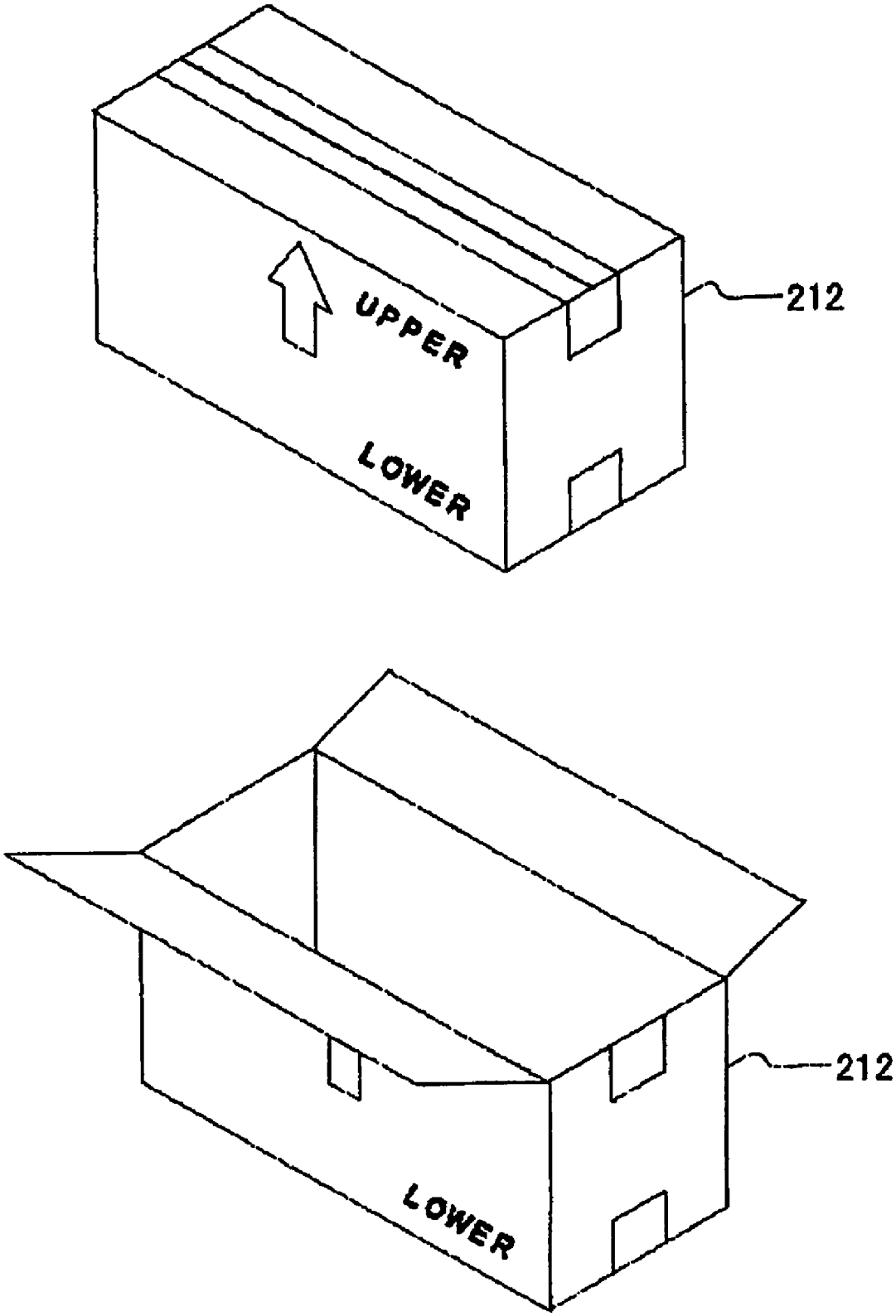
FIG. 13 is an explanatory diagram illustrating one marking method to indicate the restricted orientation of the packing case.
Figure 14:
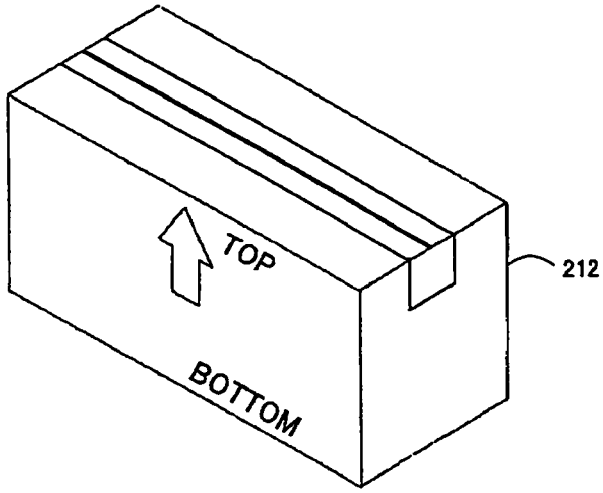
FIG. 14 is an explanatory diagram illustrating another marking method to indicate the restricted orientation of the packing case.

As shown in FIGS. 13 and 14, the packing case 212 includes markings indicating the restricted vertical orientation of the packing case 212. Specifically, an arrow pointing upward is provided on a side surface of the packing case 212 to indicate which surface should be facing up. Additionally, markings such as "upper/lower," as shown in FIG. 13, or "top/bottom," as shown in FIG. 14, may be provided on the packing case 212 in order to reliably inform the user or manufacturer of the proper vertical orientation for the packing case 212. Markings indicating the proper vertical orientation of the packing case 212 are not limited to these examples, and may be another type of marking such as "up/down." Further, the lower surface of the packing case 212 when the packing case 212 is in its proper vertical orientation may be colored differently from the other surfaces. For example, the lower surface may be colored red while the other five surfaces are not colored, enabling the user or manufacturer to clearly and visually differentiate the lower surface for the correct orientation from the other surfaces and to readily see when the packing case 212 is inverted.

Markings provided according to the method described above to indicate the proper vertical orientation of the packing case 212 can reliably inform the user or manufacturer which side of the packing case 212 should be facing up, thereby reliably preventing the user or manufacturer from placing the packing case 212 in an incorrect orientation.

The embodiments described above the packing assemblies and the packing methods for packing a used developer cartridge 24 in a packing case 212 having a upper surface that opens. Next, a packing method according to a third embodiment for packing a used developer cartridge 24 in a packing case 222 that opens on a side other than the upper surface will be described with reference to FIGS. 15 through 18.

Figure 15:
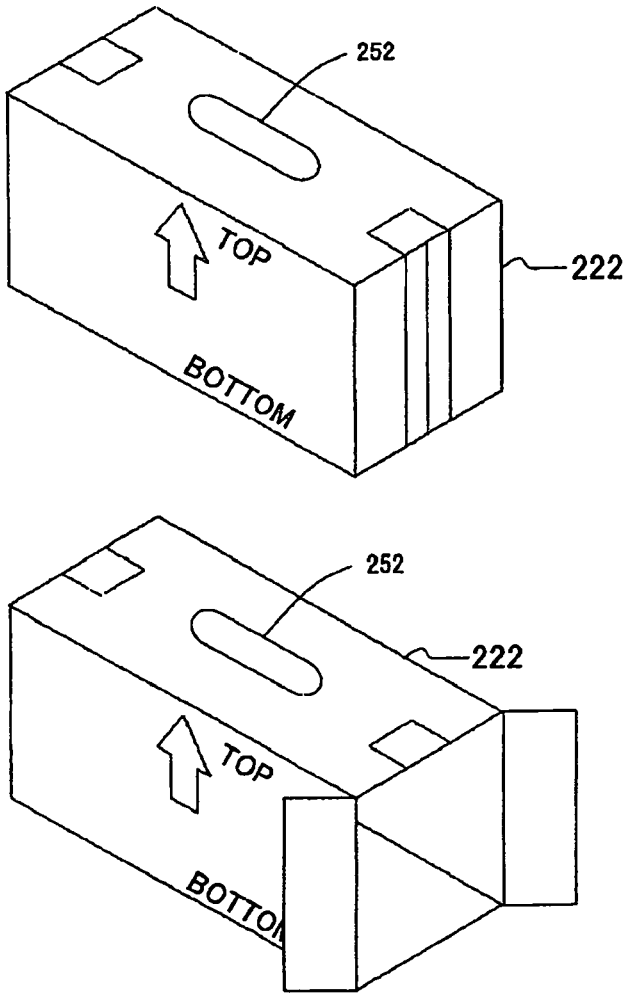
FIG. 15 is an explanatory diagram illustrating a packing case according to a third embodiment that opens on one side surface abutting one of the short upper edges of the packing case when the packing case is in its restricted orientation.

FIG. 15 shows an example of the packing case 222 that opens on a side surface abutting one of the short edges on the upper surface of the packing case 222. The user inserts a used developer cartridge (not shown) into the packing case 222 through this side. In the preferred embodiment, the developer cartridge 24 is packed in the packing case 222 so that the developing roller 27 is positioned vertically above the toner-extracting hole 60. Hereinafter, the side of the packing case 222 opposing the developing roller 27 will be referred to as the upper side, while the side opposite this side will be referred to as the lower side.

Figure 16A:
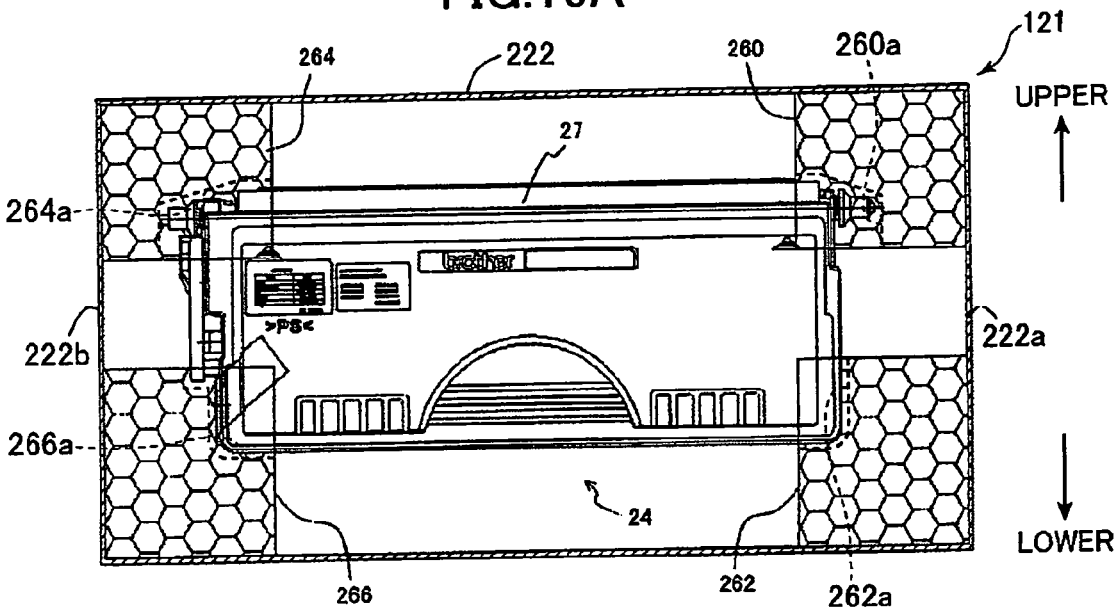
FIG. 16A is explanatory diagram showing a used developer cartridge packed together with cushioning members according to the third embodiment.

FIG. 16A shows the package 121 in the state of the developer cartridge 24 packed in the packing case 222 from a side surface abutting a long edge on the upper surface of the packing case 222. As shown in the drawing, the packing case 222 includes a side surface 222*a*, which is the side that opens, and a side surface 222*b* opposite the side surface 222*a*.

The package 121 and the packing method according to the third embodiment employ four cushioning members 260, 262, 264, and 266. The cushioning members 260 and 262 are disposed in the packing case 222 adjacent to the side surface 222*a*, while the cushioning members 264 and 266 are disposed in the packing case 222 adjacent to the side surface 222*b* opposite the side surface 222*a*. The cushioning members 260 and 262 are disposed along the pair of edges of the side surface 222*a*. The cushioning members 264 and 266 are disposed along the pair of edges of the side surface 222*b* and fixed to the inside of the side surface 222*b*. The cushioning members 260, 262, 264, and 266 are configured to accommodate the developer cartridge 24 so that the developing roller 27 is positioned vertically above the toner-extracting hole (not shown). More specifically, recessed parts 260*a*, 262*a*, 264*a*, and 266*a* are formed in portions of the respective cushioning members 260, 262, 264, and 266 that oppose the developer cartridge 24 and are shaped to fit tightly over the opposing parts of the developer cartridge 24.

Figure 16B:
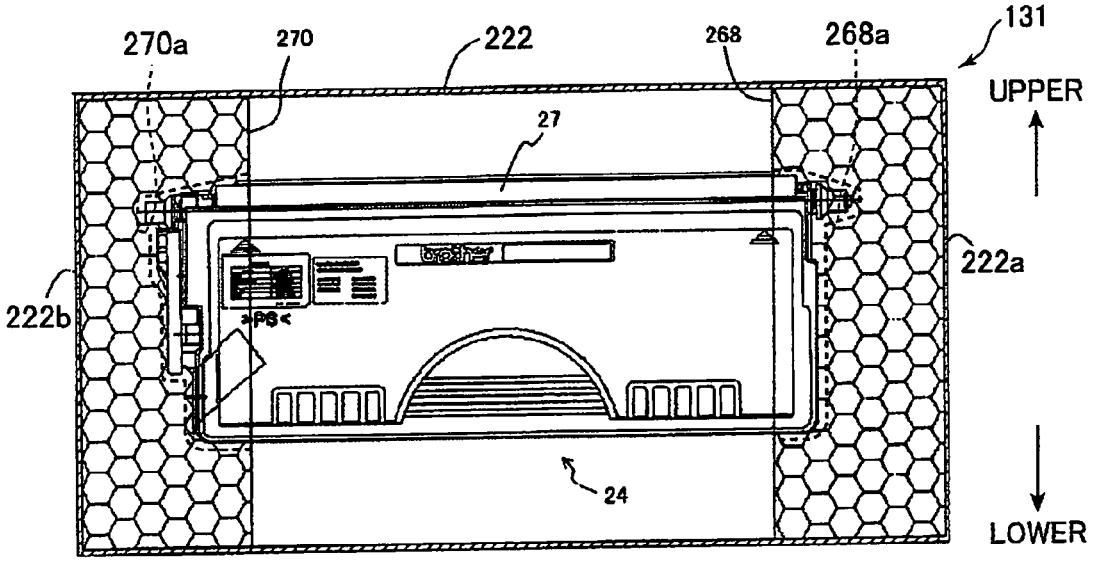
FIG. 16B is explanatory diagram showing a used developer cartridge packed together with cushioning members according to a variation of the third embodiment.

FIG. 16B illustrates a package 131 and a packing method for packing the developer cartridge 24 in the packing case 222 using cushioning members 268 and 270 that are shaped differently from the cushioning members 260, 262, 264, and 266. FIG. 16B shows the packing case 222 from a side surface abutting one long edge of the upper surface on the packing case 222. The cushioning member 268 is disposed in the side surface 222*a* side, which is the side that opens, while the cushioning member 270 is disposed in and fixed to the side surface 222*b* side. The cushioning members 268 and 270 are configured to accommodate the developer cartridge 24 so that the developing roller 27 is positioned vertically above the toner-extracting hole (not shown). More specifically, recessed parts 268*a* and 270*a* are formed in portions of the respective cushioning members 268 and 270 opposing the developer cartridge 24 and are shaped to closely fit over the opposing parts of the developer cartridge 24.

In the examples of FIGS. 16A and 16B, the cushioning members 264 and 266 and the cushioning member 270 are fixed to the inside of the side surface 222*b*. Accordingly, when the user opens the side surface 222*a* of the packing case 222 and inserts the developer cartridge 24 inside the packing case 222, the developer cartridge 24 can only be accommodated in an orientation that fits the shape of the recessed part formed in the cushioning members provided on the side surface 222*b* side. Therefore, the developer cartridge 24 is always packed in an orientation having the developing roller 27 positioned vertically above the toner-extracting hole (not shown).

Figure 17:
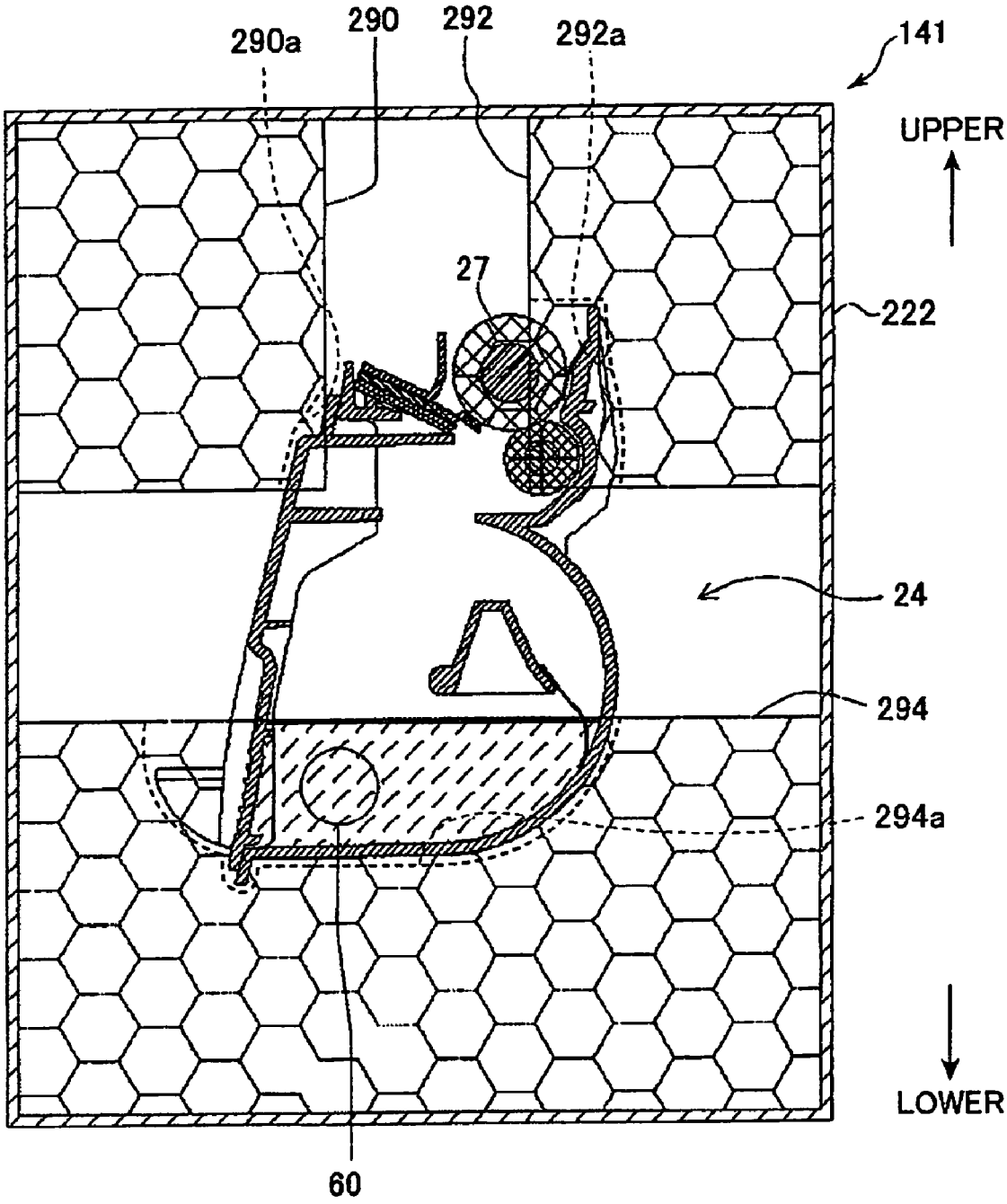
FIG. 17 is a side view illustrating another arrangement of the cushioning members according to a variation of another variation of the third embodiment.
Figure 18:
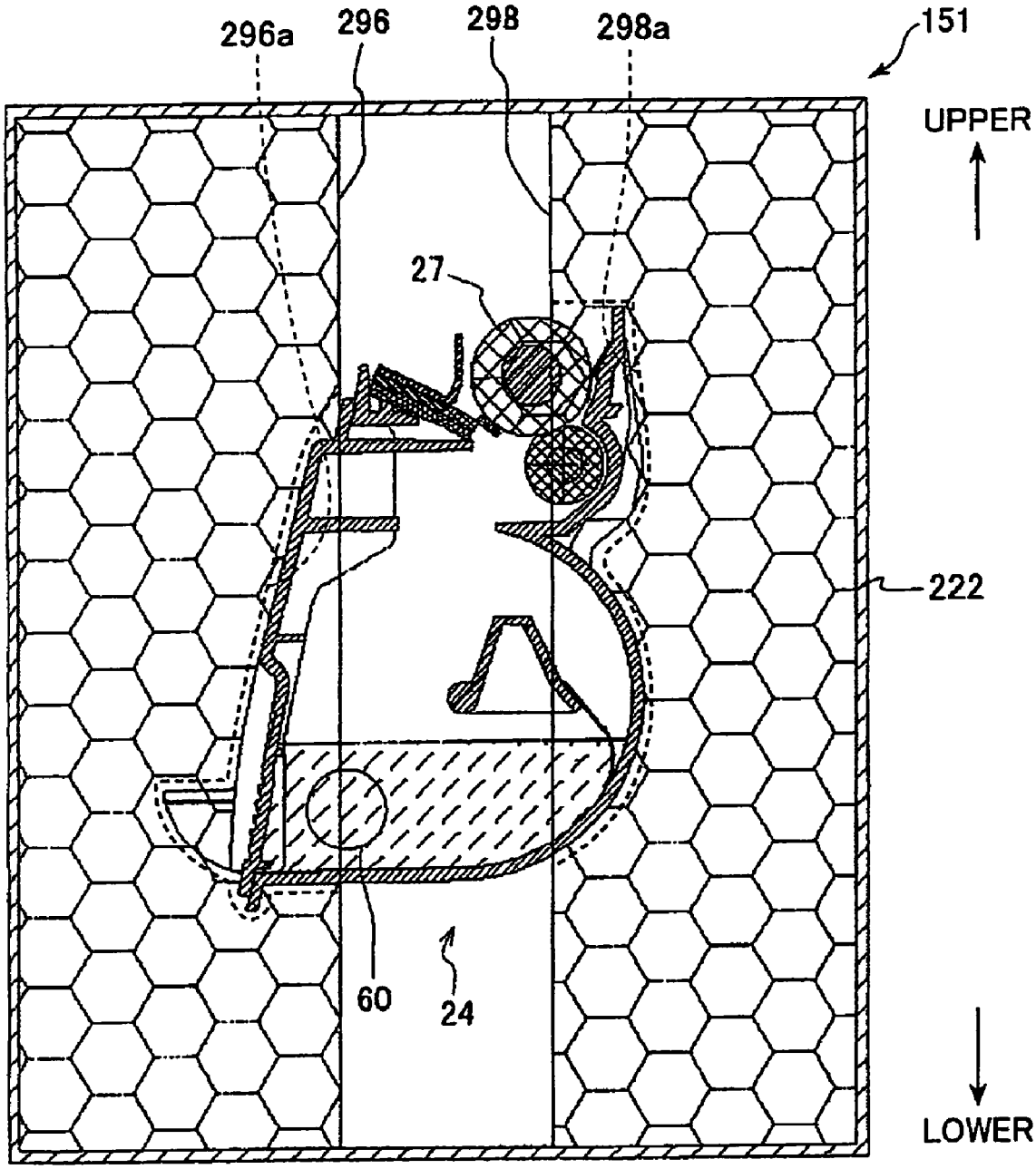
FIG. 18 is a side view illustrating another arrangement of the cushioning members according to another variation of the third embodiment.

FIGS. 17 and 18 are variations of the third embodiment having a different arrangement of the cushioning members.

In the example of FIG. 17, a package 141 includes the used developer cartridge 24, the packing case 222, and cushioning members 290, 292, and 294. The cushioning members 290 and 292 are disposed along the long edges on the upper surface of the packing case 222, while the cushioning member 294 is disposed in the lower surface of the packing case 222. These cushioning members 290, 292, and 294 are configured to accommodate the developer cartridge 24 so that the developing roller 27 is positioned vertically above the toner-extracting hole 60. More specifically, recessed parts 290*a*, 292*a*, and 294*a* are formed in portions of the cushioning members 290, 292, and 294, respectively, opposing the developer cartridge 24 and are shaped to closely fit over the opposing parts of the developer cartridge 24.

When packing the developer cartridge 24 in the packing case 222, the user first inserts the cushioning member 294 accommodating the developer cartridge 24 into the packing case 222. At this time, the developer cartridge 24 is accommodated in the cushioning member 294 so that the lower part of the developer cartridge 24 matches the shape of the recessed part 294*a* formed in the cushioning member 294. Subsequently, the user inserts the cushioning members 290 and 292 into the packing case 222 so that the recessed parts 290*a* and 292*a* closely fit over parts of the developer cartridge 24 along the long edges of the upper surface of the packing case 222. With the package 141 and the packing method, the developer cartridge 24 is maintained in the packing case 222 so that developing roller 27 is positioned vertically above the toner-extracting hole 60. Further, markings may be provided on the side surfaces of the cushioning members 290, 292, and 294 to indicate the orientation of these members when accommodated in the packing case, thereby reliably preventing the user from packing the developer cartridge 24 in another orientation.

In the example of FIG. 18, a package 151 includes the used developer cartridge 24, the packing case 222, and cushioning members 296 and 298. The cushioning members 296 and 298 are disposed along side surfaces of the packing case 222 abutting the long edges on the upper surface of the packing case 222. The cushioning members 296 and 298 are configured to accommodate the developer cartridge 24 so that the developing roller 27 is positioned vertically above the toner-extracting hole 60. More specifically, recessed parts 296*a* and 298*a* are formed in portions of the respective cushioning members 296 and 298 that oppose the developer cartridge 24 and are shaped to closely fit over the opposing parts of the developer cartridge 24.

When packing the developer cartridge 24 in the packing case 222, the user first places the cushioning members 296 and 298 over the side portions of the developer cartridge 24 and subsequently inserts the cushioning members 296 and 298 into the packing case 222 with the developer cartridge 24 accommodated therein. At this time, the developer cartridge 24 is packed in the packing case 222 with the developing roller 27 positioned vertically above the toner-extracting hole 60. Further, markings may be provided on the side surfaces of the cushioning members 296 and 298 to indicate the orientation of these members when accommodated in the packing case, thereby reliably preventing the user from packing the developer cartridge 24 in another orientation. Alternatively, the cushioning members 296 and 298 may be fixed to the inner side surfaces of the packing case 222 abutting long edges on the upper surface of the packing case 222. By cutting out a portion of the cushioning members 296 and 298 on the side surface 222*a* side to allow insertion of the developer cartridge 24, the developer cartridge 24 can be inserted through this cutout portion and positioned in an orientation that matches the shape of the recessed parts 296*a* and 298*a* in the cushioning members 296 and 298.

By packing the developer cartridge 24 in the orientation described above, toner remaining in the developing chamber 26*b* shifts toward the toner chamber 26*a* due to gravity and vibration during transport. Accordingly, by maintaining the developer cartridge 24 in the orientation used during packing, the manufacturer or recycling factory to which the developer cartridge 24 is returned can efficiently extract toner from the toner-extracting hole 60 according to the conventional method.

Figure 19:
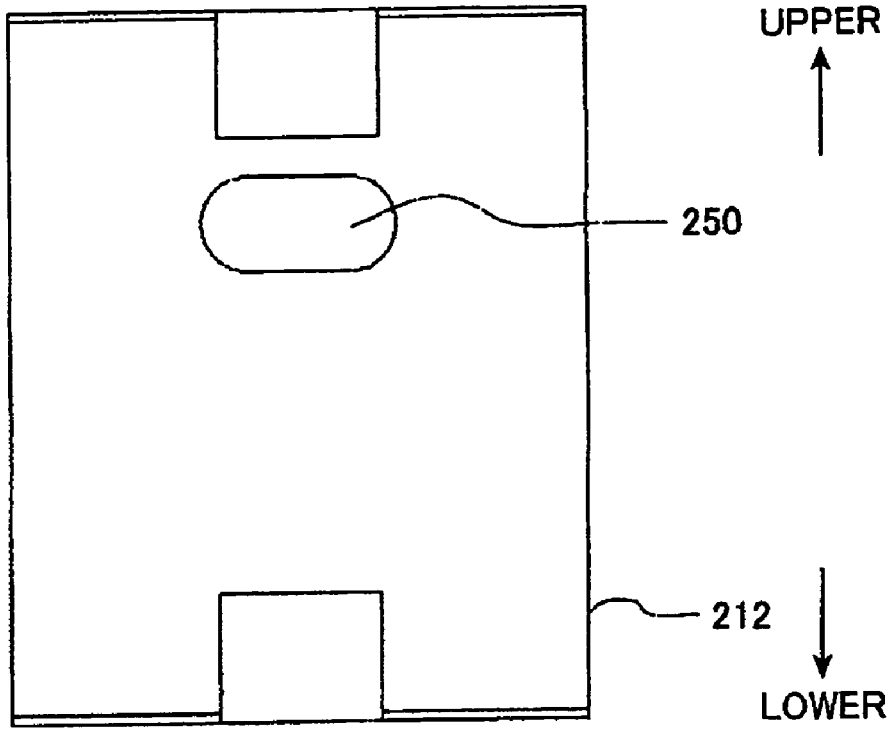
FIG. 19 is an explanatory diagram showing handles provided in the packing case.
Figure 19:
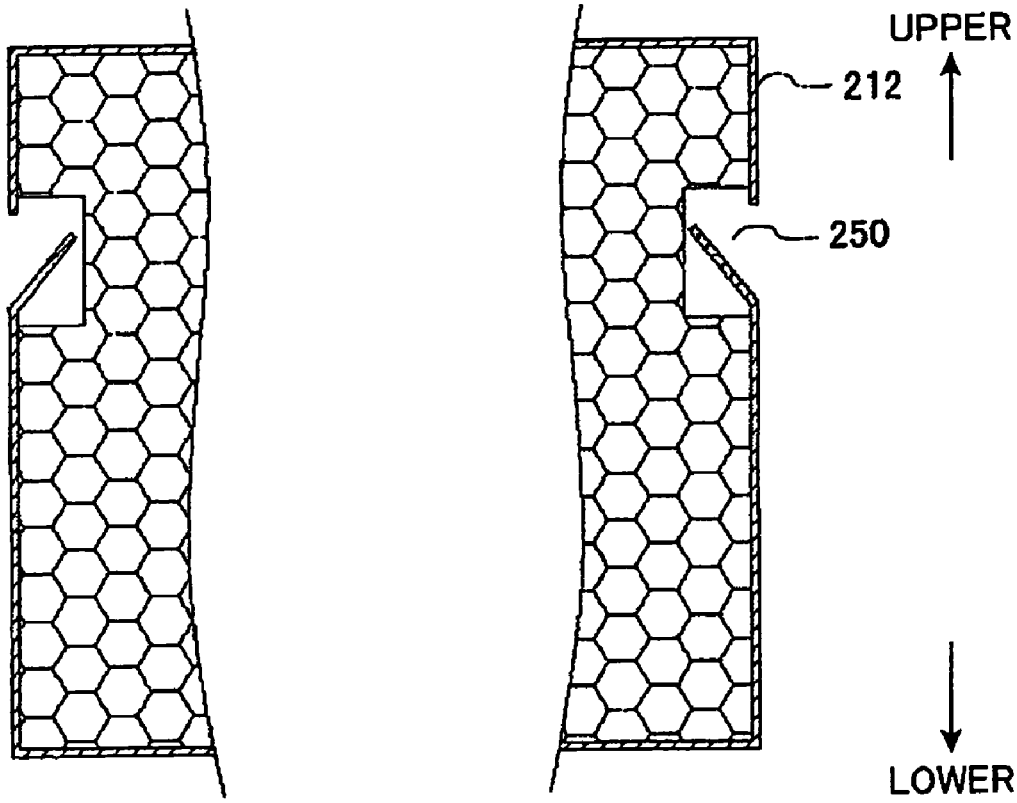

As shown in FIG. 19, handles 250 may be provided in the packing case 212 used in the packing methods according to both the first and second embodiments. The handles 250 are provided at positions above the vertical center of the packing case 212 in the upper portions of the two side surfaces of the packing case 212 that abut opposing short edges on the upper surface of the packing case 212.

When the handles 250 are provided in the positions described above, a person carrying the packing case 212 will lift the packing case 212 with the upper surface facing upward without needing to consciously consider the proper vertical orientation. Hence, the position of the handles 250 can prevent a person from carrying the packing case 212 with the lower surface facing up.

With the packing case 222 used in the packing method according to the third embodiment (see FIG. 15), at least one handle 252 may be provided on the upper surface of the packing case 222.

By providing a handle in this position, a person carrying the packing case 222 will lift the packing case 222 with the upper surface facing upward without needing to consciously consider the proper vertical orientation. Hence, the position of the handle 252 can prevent a person from carrying the packing case 222 with the lower surface facing up.

While the preferred embodiments described above the packing assemblies and packing methods for packing used a developer cartridge 24, the same orientation of the developer cartridge 24 may also be used when packing a new developer cartridge 24.

Figure 20:
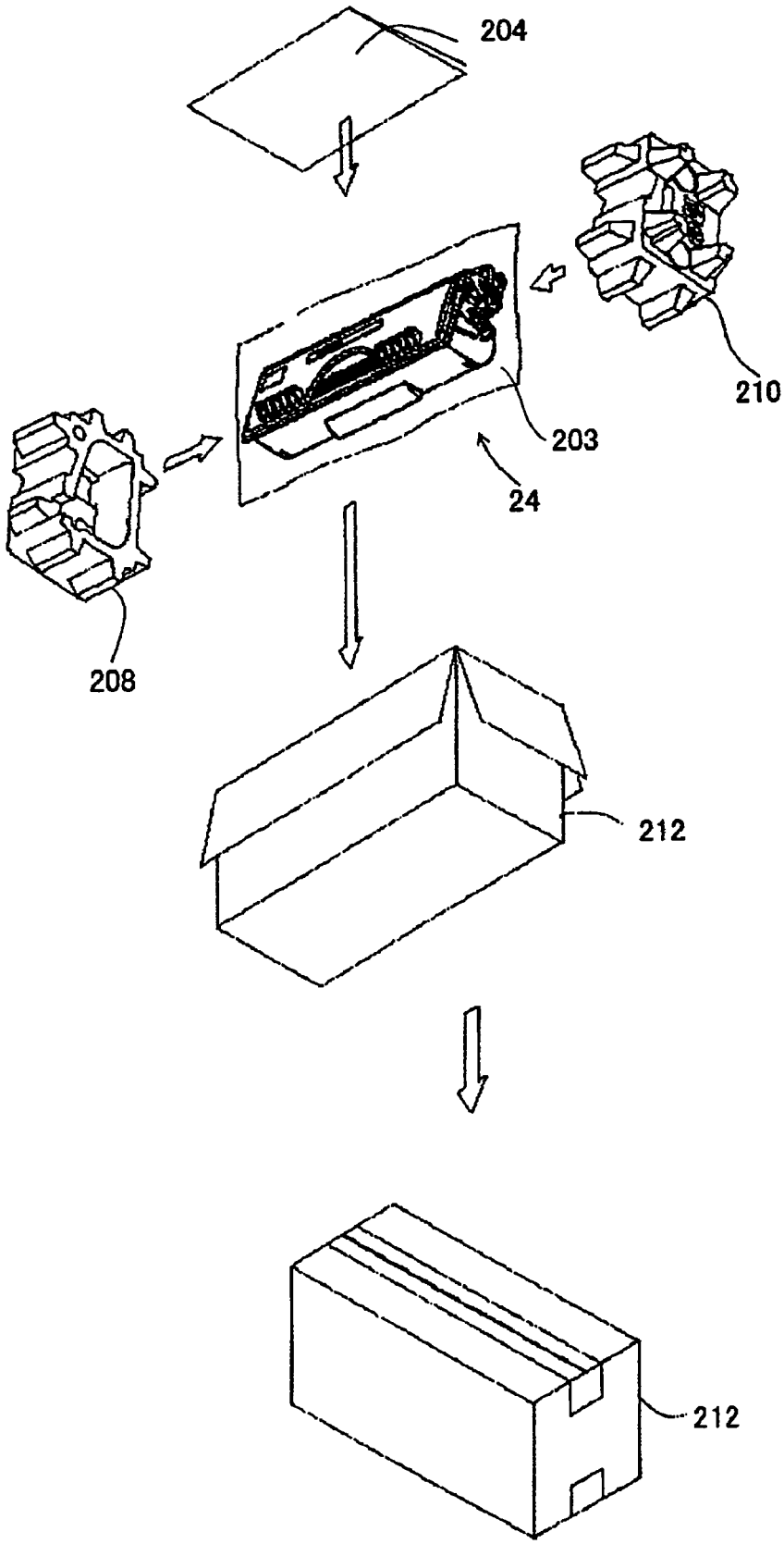
FIG. 20 is an exploded perspective view illustrating a method of packing a new developer cartridge according to a fourth embodiment.
Figure 21:
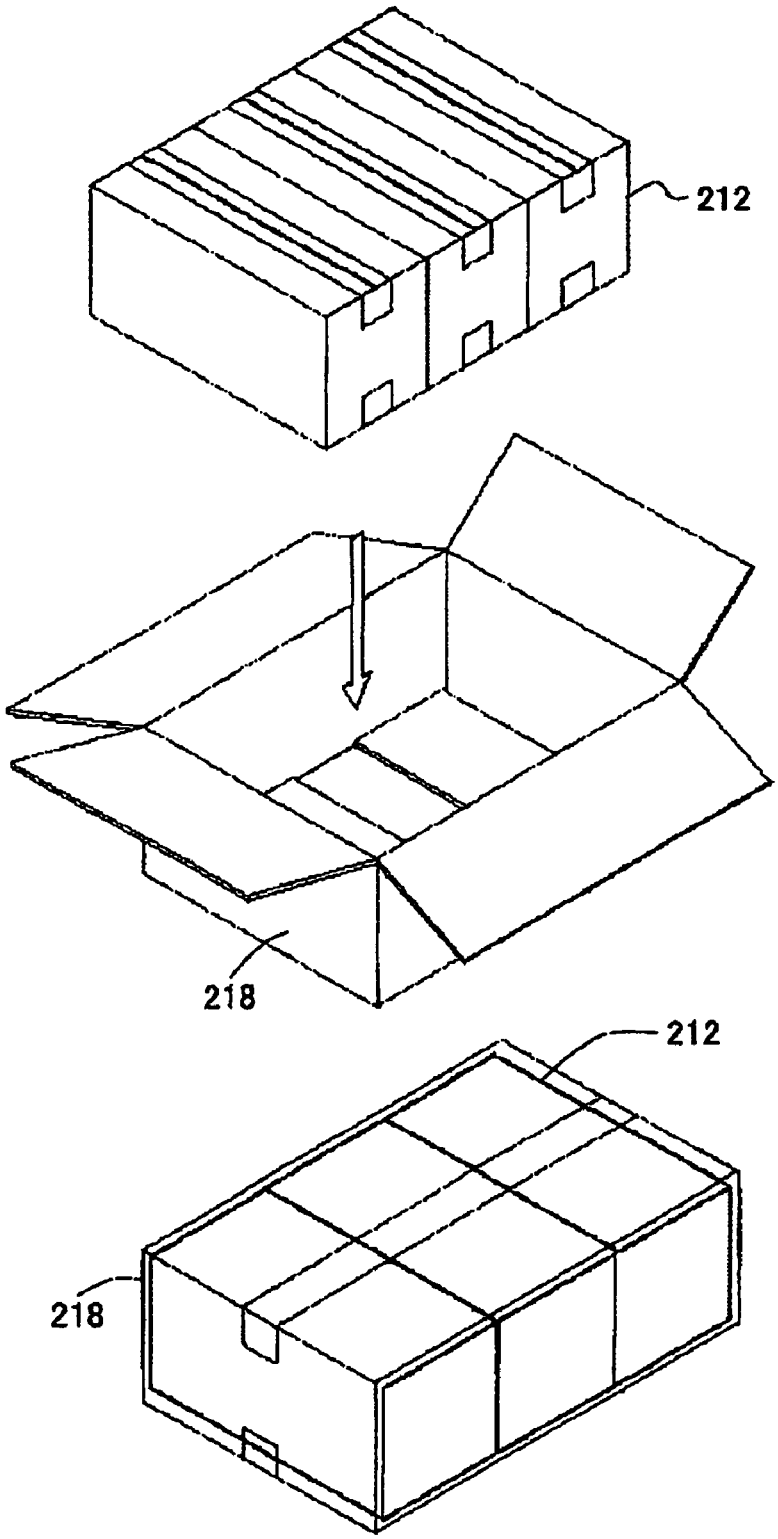
FIG. 21 is an exploded perspective view illustrating the method of packing a new developer cartridge according to the fourth embodiment.
Figure 22:
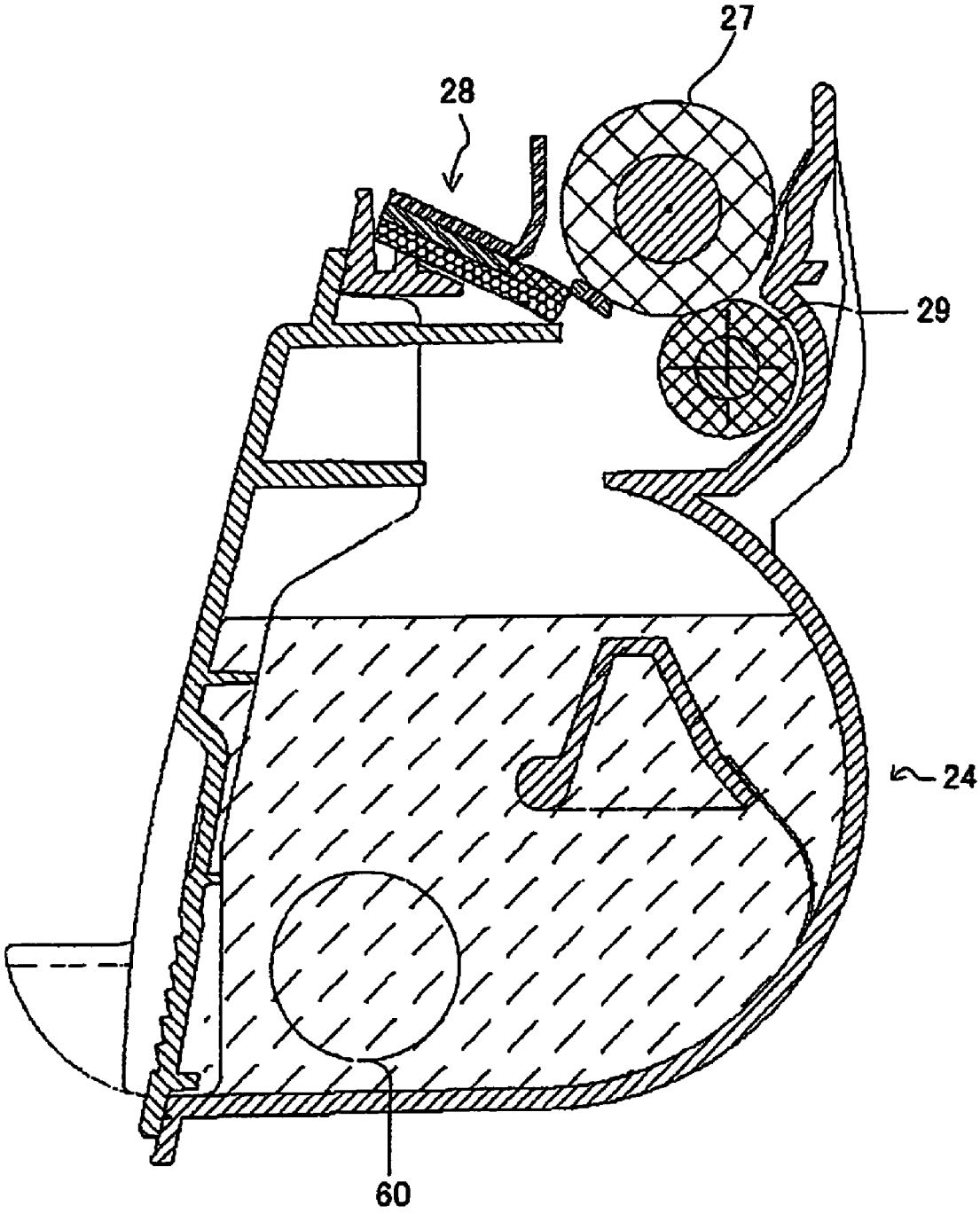
FIG. 22 is a side cross-sectional view of a used developer cartridge when packed in the packing case.

FIGS. 20 and 21 are exploded perspective views illustrating a method of packing a new developer cartridge 24 according to a fourth embodiment using the methods described above. FIG. 22 is a side cross-sectional view of the developer cartridge 24 when the developer cartridge 24 is in its packed orientation.

The developer cartridge 24 is covered in an aluminum foil envelope or other material 203 that is impervious to water. Both side ends of the developer cartridge 24 are fixed in cushioning members 208 and 210 formed of Styrofoam or the like. This assembly is then packed in the packing case 212 together with an operating manual 204 and the like. At this time, the packed developer cartridge 24 is oriented such that the developing roller 27 is positioned vertically above the toner-extracting hole 60 (see FIG. 22). A plurality of these packing cases 212 with their upper surfaces facing upward are subsequently packed in a larger packing container 218 prior to shipping from the factory. In the example shown in FIG. 21, three of the packing cases 212 are packed together in the larger packing container 218. However, the packing cases 212 may be shipped in another predetermined number or as single units. When the user later mounts this developer cartridge 24 in an image-forming device, the user can save the leftover packing case 212 and cushioning members 208 and 210 for later use.

Figure 23:
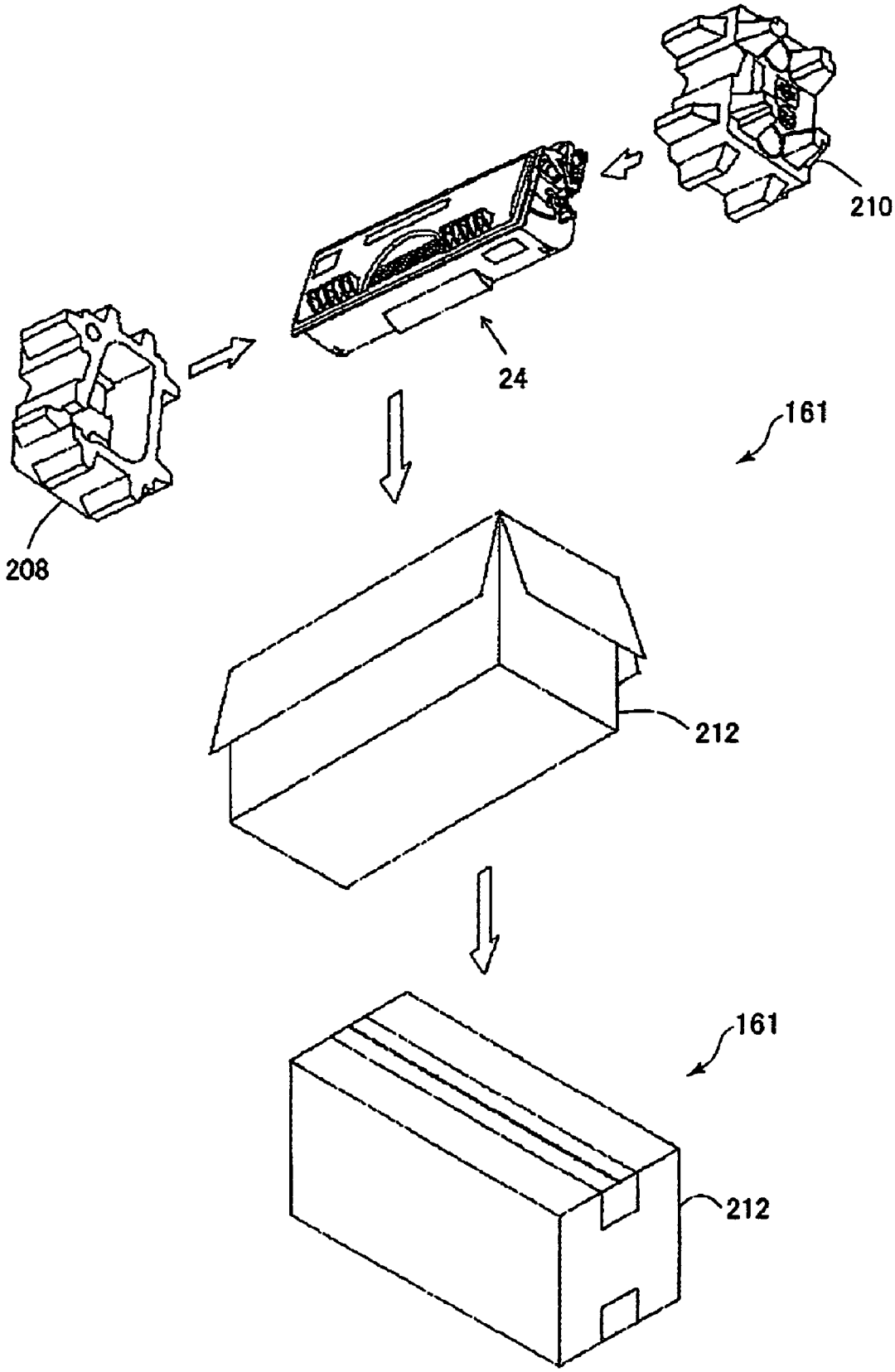
FIG. 23 is an exploded perspective view illustrating a package and a method of packing a used developer cartridge according to a fifth embodiment.

Next, a package 161 and a packing method for packing a used developer cartridge 24 according to a fifth embodiment will be described with reference to FIG. 23. As shown in FIG. 23, the package 161 has the used developer cartridge 24, the packing case 212, and the cushioning members 208 and 210. When a developer cartridge mounted in the laser printer 1 runs out of toner and must be replaced, the user places the developer cartridge 24 in one of the packing cases 212 saved as described above in the fourth embodiment. At this time, the user will generally pack the used developer cartridge 24 in the same way that the new developer cartridge 24 was packed without needing to think how the cartridge should be packed. Since the new developer cartridge was packed with the developing roller 27 positioned vertically above the toner-extracting hole 60, in the preferred embodiment the user will pack the used developer cartridge 24 in the same orientation. Specifically, the user will insert both ends of the used developer cartridge 24 into the cushioning members 208 and 210 such that the developing roller 27 is positioned vertically above the toner-extracting hole 60 (see FIG. 22) and will then place this assembly in the packing case 212.

By packing the developer cartridge 24 in the orientation described above, toner remaining in the developing chamber 26*b* shifts toward the toner chamber 26*a* due to gravity and vibration during transport. Accordingly, by maintaining the developer cartridge 24 in the orientation during packing, the manufacturer or prescribed recycling factory to which the developer cartridge 24 is returned can efficiently extract toner according to the conventional method from the toner-extracting hole 60 positioned on the lower portion of the casing 24*a* to which the toner has shifted.

While the cushioning members are formed of Styrofoam in the above description, these members may be formed of any material that is sufficiently strong to restrict movement of the developer cartridge 24 in the packing case 212. Further, the cushioning members must be highly shock-absorbent and amenable to shaping in order to accommodate the developer cartridge in a prescribed orientation. Further, when the cushioning members are fixed to the inside of the packing case, it is desirable that the members be formed of the same material as the packing case, such as molded pulp, to facilitate sorting for recycling.

While the packages include the used developer cartridge 24 in the above description, the packages may include the process unit 18 having the used developer cartridge 24. Further, in the packing method, while the used developer cartridge 24 is accommodated in the packing case and cushion members in the above description, the process unit 18 having the used developer cartridge 24 may be accommodated in the packing case and cushion members.

What is claimed is:

1. A packing method for a used process cartridge, the used process cartridge comprising a developer-accommodating section that accommodates a developer and is formed with a developer-extracting hole for extracting residual developer therefrom, a developer-carrying member that carries the developer, and a developing section disposed adjacent to the developer-accommodating section, the developer-carrying member being disposed in the developing section, the packing method comprising:

packing the used developer cartridge so that the developer-carrying member is positioned vertically above the developer-extracting hole, wherein the developer-extracting hole is formed below a vertical center of the developer-accommodating section when the used process cartridge is oriented so that the developer-carrying member is positioned vertically above the developer-extracting hole.

2. The packing method according to claim 1, wherein the used process cartridge further comprises developer-supplying unit in the developing section for supplying developer to the developer-carrying member; and the used process cartridge is packed so that the developer-supplying unit is positioned vertically above the developer-extracting hole.

3. The packing method according to claim 1, wherein the used process cartridge further comprises a thickness-regulating unit disposed in the developing section, the thickness regulating unit regulating a thickness of developer carried on the developer-carrying member; and the used process cartridge is packed so that the thickness-regulating unit is positioned vertically above the developer-extracting hole.

4. A package comprising:

a used process cartridge comprising a developer-accommodating section that accommodates a developer and is formed with a developer-extracting hole for extracting residual developer therefrom, a developer-carrying member that carries the developer, and a developing section disposed adjacent to the developer-accommodating section, the developer-carrying member being disposed in the developing section;

a packing case with a restricted orientation that accommodates the used process cartridge; and a cushioning member accommodated in the packing case that restricts movement of the used process cartridge in the packing case, wherein the cushioning member is shaped to accommodate the used process cartridge in an orientation such that the developer-carrying member is positioned vertically above the developer-extracting hole when the packing case is maintained with an upper surface on top, wherein the developer-extracting hole is positioned below a vertical center of the developer-accommodating section when the used process cartridge is oriented so that the developer-carrying member is positioned vertically above the developer-extracting hole.

5. The package according to claim 4, wherein the cushioning member includes a recessed part formed in a portion opposing the used process cartridge and having a shape that closely fits with the opposing portion of the used process cartridge.

6. The package according to claim 4, wherein the used process cartridge further comprises developer-supplying unit in the developing section that supplies developer to the developer-carrying member; and the used process cartridge is packed so that the developer-supplying unit is positioned vertically above the developer-extracting hole.

7. The package according to claim 4, wherein the used process cartridge further comprises thickness-regulating unit disposed in the developing section that regulates the thickness of developer carried on the developer-carrying member; and the used process cartridge is packed so that the thickness-regulating unit is positioned vertically above the developer-extracting hole.

8. The package according to claim 4, wherein the packing case has an upper surface that can be opened and a lower surface; and the cushioning member comprises an upper portion opposing the upper surface of the packing case and a lower portion opposing the lower surface of the packing case, and the lower portion of the cushioning member opposing the lower surface of the packing case is fixed to at least a portion on an inside lower surface of the packing case.

9. The package according to claim 4, wherein the packing case comprises:

an upper surface that can be opened; and handles used to carry the packing case, the handles being disposed in positions above a vertical center of the packing case on a first side surface abutting one edge on the upper surface of the packing case and a second side surface opposite the first side surface.

10. The package according to claim 4, further comprising a first side surface that can be opened, the first side surface abutting an edge of the upper surface;

wherein the cushioning member comprises a portion opposing the first side surface and a portion opposing a second side surface opposite the first side surface, and the cushioning member opposing the second side surface is fixed to at least a portion on the inside thereof.

11. The package according to claim 10, wherein the packing case comprises handles used to carry the packing case, at least one of the handles being disposed on the upper surface of the packing case.

12. The package according to claim 4, further comprising a positioning member fixed inside the packing case that positions the cushioning member at a prescribed position in the packing case, the cushioning member and the positioning member being shaped such that at least a portion of each conforms to each other, and the cushioning member being accommodated in a prescribed position of the packing case when the conforming portions of the cushioning member and the positioning member are in contact with each other.

13. The package according to claim 4, wherein the packing case further comprises an indicating part that indicates the restricted orientation of the packing case.

14. A packing assembly for use in accommodating a process cartridge comprising a developer-accommodating section that accommodates a developer and is formed with a developer-extracting hole for extracting residual developer therefrom, a developer-carrying member that carries the developer, and a developing section disposed adjacent to the developer-accommodating section, the developer-carrying member being disposed in the developing section, the packing assembly comprising:

a packing case with a restricted orientation that accommodates the process cartridge; and a cushioning member accommodated in the packing case that restricts movement of the process cartridge in the packing case, wherein the cushioning member is shaped to accommodate the process cartridge in an orientation such that the developer-carrying member is positioned vertically above the developer-extracting hole when the process cartridge is placed in the packing case, and the upper surface of the packing case is facing upward, wherein the developer-extracting hole is positioned below a vertical center of the developer-accommodating section when the used process cartridge is oriented so that the developer-carrying member is positioned vertically above the developer-extracting hole.

15. The packing assembly according to claim 14, wherein the cushioning member includes a recessed part formed in a portion opposing the process cartridge and having a shape that closely fits with the opposing portion of the process cartridge.

16. The packing assembly according to claim 14, wherein the packing case has an upper surface that can be opened and a lower surface; and the cushioning member comprises an upper portion opposing the upper surface of the packing case and a lower portion opposing the lower surface of the packing case, and the lower portion of the cushioning member opposing the lower surface of the packing case is fixed to at least a portion on an inside lower surface of the packing case.

17. The packing assembly according to claim 14, wherein the packing case comprises:

an upper surface that can be opened; and handles used to carry the packing case, the handles being disposed in positions above a vertical center of the packing case on a first side surface abutting one edge on the upper surface of the packing case and a second side surface opposite the first side surface.

18. The packing assembly according to claim 14, further comprising a first side surface that can be opened, the first side surface abutting an edge of the upper surface;

wherein the cushioning member comprises a portion opposing the first side surface and a portion opposing a second side surface opposite the first side surface, and the cushioning member opposing the second side surface is fixed to at least a portion on the inside thereof.

19. The packing assembly according to claim 18, wherein the packing case comprises handles used to carry the packing case, at least one of the handles being disposed on the upper surface of the packing case.

20. The packing assembly according to claim 14, further comprising a positioning member fixed inside the packing case that positions the cushioning member at a prescribed position in the packing case, the cushioning member and the positioning member being shaped such that at least a portion of each conforms to each other, and the cushioning member being accommodated in a prescribed position of the packing case when the conforming portions of the cushioning member and the positioning member are in contact with each other.

21. The packing assembly according to claim 14, wherein the packing case further comprises indicating part that indicates the restricted orientation of the packing case.

* * * * *